US011624583B2

(12) United States Patent
Faifer

(10) Patent No.: US 11,624,583 B2
(45) Date of Patent: Apr. 11, 2023

(54) VARIABLY ADJUSTABLE STOCK FOR A GUN AND APPARATUS AND METHOD FOR ADJUSTMENT OF SAME

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 0 days.

(21) Appl. No.: 17/000,280

(22) Filed: Aug. 22, 2020

(65) Prior Publication Data

US 2021/0018296 A1 Jan. 21, 2021

Related U.S. Application Data

(63) Continuation-in-part of application No. 29/698,414, filed on Jul. 16, 2019, now Pat. No. Des. 907,157.

(60) Provisional application No. 62/890,362, filed on Aug. 22, 2019.

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/20
See application file for complete search history.

(56) References Cited

U.S. PATENT DOCUMENTS 294,402 A 3/1884 Onderdonk
319,613 A 6/1885 Onderdonk
436,997 A 9/1890 Quackenbush
746,859 A 12/1903 Marble
922,173 A 5/1909 Lovelace
931,328 A 8/1909 Marble
961,511 A 6/1910 Marble
1,051,960 A 2/1913 Kennedy
1,086,490 A 2/1914 Weathers
1,156,293 A 10/1915 Jorgenson
1,174,840 A 3/1916 Fisher
1,315,215 A 9/1919 Davidson
1,485,456 A 3/1924 Frommer
1,526,847 A 2/1925 Fritz
1,734,852 A 11/1929 Frampton et al.
1,822,875 A 9/1931 Ammann
2,098,139 A 11/1937 Foley et al.
2,400,422 A 5/1946 Johnson, Jr.
2,424,194 A 7/1947 Sampson et al.
2,433,151 A 12/1947 Parsons
2,766,542 A 10/1956 Harvey
(Continued)

*Primary Examiner* — J. Woodrow Eldred
(74) *Attorney, Agent, or Firm* — Law Office of Arthur M. Antonelli, PLLC

(57) ABSTRACT

A stock for a gun is disclosed which includes a butt stock body (12). The butt stock body may include a butt plate receptacle (108). The stock further may include a butt plate assembly (20) positioned in the butt plate receptacle (108), a cheek piece (18) releasably secured to the butt stock body (12) and the butt plate assembly (20), and a clamp (30). The stock may include first and second configurations such that in the first configuration the clamp permits independent movement of the butt plate assembly (20) and the cheek piece (18), and in the second configuration the clamp fixes movement of the butt plate assembly and the cheek piece relative to the butt stock body. The clamp (30) may be assembled within the stock body (12) to provide for variable adjustment of the butt stock with a dominant hand on the firearm grip.

22 Claims, 24 Drawing Sheets

(56) References Cited

U.S. PATENT DOCUMENTS 3,044,204 A 7/1962 Zimmerman
3,348,328 A 10/1967 Roy
3,618,248 A 11/1971 Into et al.
3,618,249 A 11/1971 Grandy
4,115,943 A 9/1978 Musgrave
4,141,166 A 2/1979 Schultz
4,271,623 A 6/1981 Beretta
4,327,626 A 5/1982 McQueen
4,383,384 A 5/1983 Fox
4,512,101 A 4/1985 Waterman, Jr.
4,551,937 A 12/1985 Seehase
4,697,367 A 10/1987 Brophy
4,735,007 A 4/1988 Gal
4,788,785 A 12/1988 White
D324,557 S 3/1992 Livingston
5,209,215 A 5/1993 Morrison
5,225,613 A 7/1993 Claridge
5,622,000 A 4/1997 Marlowe
5,711,102 A 1/1998 Plaster et al.
D391,334 S 2/1998 Plaster et al.
5,907,918 A 6/1999 Langevin et al.
6,250,194 B1 6/2001 Brandl et al.
6,560,911 B2 5/2003 Sharp
6,598,329 B1 7/2003 Alexander
6,598,330 B2 7/2003 Garrett et al.
6,637,141 B1 10/2003 Weatherby et al.
6,651,371 B2 11/2003 Fitzpatrick et al.
6,779,289 B2 8/2004 Kay
6,829,855 B2 12/2004 Seifert
6,839,998 B1 1/2005 Armstrong
6,874,267 B2 4/2005 Fitzpatrick et al.
6,925,743 B1 8/2005 DiGiovanna
D517,637 S 3/2006 Murello et al.
7,104,001 B1 9/2006 Digiovanna
7,131,228 B2 11/2006 Hochstrate et al.
7,152,355 B2 12/2006 Fitzpatrick et al.
7,162,822 B1 1/2007 Heayn et al.
7,162,823 B2 1/2007 Schoppman et al.
7,337,573 B1 3/2008 Digiovanna
7,398,616 B1 7/2008 Weir
7,418,797 B1 9/2008 Crose
7,428,794 B2 9/2008 Oz
D584,373 S 1/2009 Young
D589,578 S 3/2009 Choma
D600,304 S 9/2009 Fitzpatrick et al.
D600,305 S 9/2009 Fitzpatrick et al.
D600,306 S 9/2009 Fitzpatrick et al.
D600,307 S 9/2009 Fitzpatrick et al.
D600,308 S 9/2009 Fitzpatrick et al.
7,587,852 B1 9/2009 Harms
D602,555 S 10/2009 Fitzpatrick et al.
D603,013 S 10/2009 Fitzpatrick et al.
D604,793 S 11/2009 Fitzpatrick et al.
D604,794 S 11/2009 Bentley
7,610,711 B2 11/2009 Oz
D606,614 S 12/2009 Fitzpatrick et al.
D607,078 S 12/2009 Chu
7,627,975 B1 12/2009 Hines
7,640,688 B2 1/2010 Oz
7,647,719 B2 1/2010 Fitzpatrick et al.
7,654,187 B2 2/2010 Hochstrate et al.
7,681,351 B2 3/2010 Bucholtz et al.
D616,056 S 5/2010 Bentley
7,743,544 B2 6/2010 Laney et al.
D620,067 S 7/2010 Saur
7,762,018 B1 7/2010 Fitzpatrick et al.
D622,802 S 8/2010 Fitzpatrick et al.
7,775,150 B2 8/2010 Hochstrate et al.
7,805,873 B2 10/2010 Bentley
7,810,270 B2 10/2010 Fitzpatrick et al.
7,823,313 B2 11/2010 Faifer
7,827,722 B1 11/2010 Davies
7,849,626 B2 12/2010 Fluhr
D631,122 S 1/2011 Domagtoy
D634,388 S 3/2011 Peterson et al.
D636,833 S 4/2011 Mayberry et al.
D636,834 S 4/2011 Mayberry et al.
7,930,849 B2 4/2011 Abraham et al.
7,937,873 B2 5/2011 Keng
D640,342 S 6/2011 Fitpatrick et al.
7,966,760 B2 6/2011 Fitzpatrick et al.
7,992,336 B2 8/2011 Phillips
8,006,425 B2 8/2011 Burt et al.
D645,533 S 9/2011 Petersom et al.
8,061,072 B1 11/2011 Crose
8,127,483 B2 3/2012 Kincel
8,127,485 B2 3/2012 Kincel
D661,366 S 6/2012 Zusman
8,191,299 B2 6/2012 Faifer
D668,311 S 10/2012 Rogers et al.
8,327,568 B1 12/2012 Lavergne et al.
8,341,868 B2 1/2013 Zusman
D676,921 S 2/2013 Fitzpatrick et al.
8,387,298 B2 3/2013 Kincel
D683,808 S 6/2013 Elkaim
D688,768 S 8/2013 Fitzpatrick et al.
D691,234 S 10/2013 Fitzpatrick et al.
D692,087 S 10/2013 Fitzpatrick et al.
8,555,541 B2 10/2013 Ingram
D695,377 S 12/2013 Mayberry et al.
D697,162 S 1/2014 Faifer
D700,265 S 2/2014 Mayberry et al.
8,707,603 B2 4/2014 Troy et al.
D704,294 S 5/2014 Jarboe
8,756,849 B2 6/2014 Troy
8,800,189 B2 8/2014 Fitzpatrick et al.
8,813,157 B2 8/2014 Le Leannec et al.
D712,998 S 9/2014 Gomez
8,844,185 B2 9/2014 Jarboe
D716,403 S 10/2014 Burt et al.
8,943,728 B2 2/2015 Ward et al.
D725,219 S 3/2015 Hirt et al.
8,978,284 B1 3/2015 Zusman
D736,336 S 8/2015 Mayberry et al.
D745,627 S 12/2015 Kielsmeier et al.
D748,216 S 1/2016 Zusman
9,228,795 B1 1/2016 Kielsmeier et al.
9,239,203 B2 1/2016 Jarboe et al.
D753,782 S 4/2016 Vazquez et al.
9,322,611 B1 4/2016 Barfoot et al.
D755,323 S 5/2016 Eitan et al.
D755,331 S 5/2016 Eitan et al.
D757,883 S 5/2016 Chow et al.
D757,885 S 5/2016 Barfoot et al.
D764,622 S 8/2016 Bosco et al.
9,404,708 B1 8/2016 Chow et al.
9,410,764 B2 8/2016 Jarboe
9,429,387 B1 8/2016 Barfoot et al.
D769,396 S 10/2016 Keller, II
9,464,863 B2 10/2016 Mather et al.
9,488,434 B2 11/2016 Kielsmeier et al.
9,488,435 B1 11/2016 Roberts et al.
D773,592 S 12/2016 Jones
D773,593 S 12/2016 Hopkins et al.
9,541,347 B2 1/2017 Maugham
9,551,549 B1 1/2017 Chvala
D779,018 S 2/2017 Zayatz et al.
D780,279 S 2/2017 Bosco et al.
9,581,411 B2 2/2017 Zusman
D781,392 S 3/2017 Zayatz et al.
D785,122 S 4/2017 Mather et al.
9,612,084 B2 4/2017 Barfoot et al.
9,664,476 B1 5/2017 Robinson et al.
9,664,479 B1 5/2017 Robinson et al.
D792,936 S 7/2017 Eitan et al.
D792,937 S 7/2017 Eitan et al.
D795,981 S 8/2017 Martelli et al.
D795,982 S 8/2017 Ottosen
D795,985 S 8/2017 Frederickson et al.
9,739,565 B2 8/2017 Kielsmeier et al.
9,746,281 B2 8/2017 Wilson et al.
D796,617 S 9/2017 Chow et al.
D798,984 S 10/2017 Roberts et al.
9,784,526 B2 10/2017 Chow et al.

(56) References Cited

U.S. PATENT DOCUMENTS

| | | | |
|---|---|---|---|
| D804,602 | S | 12/2017 | Barfoot et al. |
| D809,621 | S | 2/2018 | Lam et al. |
| D810,225 | S | 2/2018 | Huang et al. |
| D814,597 | S | 4/2018 | Thornton |
| D818,074 | S | 5/2018 | Ding et al. |
| D819,765 | S | 6/2018 | Kafka et al. |
| 10,036,602 | B1 | 7/2018 | Nuss et al. |
| 10,041,760 | B2 | 8/2018 | Keller, II |
| 10,054,394 | B2 | 8/2018 | Jen et al. |
| 10,060,699 | B1 | 8/2018 | Hu |
| D828,476 | S | 9/2018 | Smith et al. |
| D831,149 | S | 10/2018 | Barfoot et al. |
| 10,215,526 | B2 | 2/2019 | Shinkle et al. |
| D847,933 | S | 5/2019 | Windfeldt |
| 10,386,138 | B2 | 8/2019 | Nuss et al. |
| D865,898 | S | 11/2019 | Windfeldt |
| D868,924 | S | 12/2019 | Nuss et al. |
| D871,536 | S | 12/2019 | Lessard et al. |
| D883,419 | S | 5/2020 | Windfeldt |
| 2003/0101631 | A1 | 6/2003 | Fitzpatrick et al. |
| 2003/0110675 | A1 | 6/2003 | Garrett et al. |
| 2003/0196366 | A1 | 10/2003 | Beretta |
| 2003/0200693 | A1 | 10/2003 | Seifert |
| 2004/0016167 | A1 | 1/2004 | Fitzpatrick et al. |
| 2004/0055200 | A1 | 3/2004 | Fitzpatrick et al. |
| 2004/0211104 | A1 | 10/2004 | Eberle |
| 2004/0255505 | A1 | 12/2004 | Fitzpatrick |
| 2005/0108915 | A1 | 5/2005 | Kincel |
| 2005/0235546 | A1 | 10/2005 | Wonisch et al. |
| 2005/0262752 | A1 | 12/2005 | Robinson et al. |
| 2006/0096146 | A1 | 5/2006 | Fitzpatrick et al. |
| 2006/0254414 | A1 | 11/2006 | Kuczynko et al. |
| 2007/0261284 | A1 | 11/2007 | Keng |
| 2008/0028662 | A1 | 2/2008 | Abraham et al. |
| 2008/0236016 | A1 | 10/2008 | Fitzpartick et al. |
| 2008/0236017 | A1 | 10/2008 | Fitzpatrick et al. |
| 2008/0301994 | A1 | 12/2008 | Langevin et al. |
| 2009/0139128 | A1 | 6/2009 | Fluhr |
| 2009/0178325 | A1 | 7/2009 | Veilleux |
| 2009/0241397 | A1 | 10/2009 | Fitzpatrick et al. |
| 2009/0255161 | A1 | 10/2009 | Fitzpatrick et al. |
| 2009/0277066 | A1 | 11/2009 | Burt et al. |
| 2010/0115817 | A1 | 5/2010 | Faifer |
| 2010/0180485 | A1 | 6/2010 | Cabahug et al. |
| 2010/0192444 | A1 | 8/2010 | Cabahug et al. |
| 2010/0192446 | A1 | 8/2010 | Darian |
| 2010/0192447 | A1 | 8/2010 | Cabahug et al. |
| 2010/0205846 | A1 | 8/2010 | Fitzpatrick et al. |
| 2010/0229444 | A1 | 9/2010 | Faifer |
| 2010/0251591 | A1 | 10/2010 | Burt et al. |
| 2010/0275489 | A1 | 11/2010 | Cabahug et al. |
| 2010/0300277 | A1 | 12/2010 | Hochstrate et al. |
| 2011/0099872 | A1 | 5/2011 | Bentley |
| 2011/0173863 | A1 | 7/2011 | Ingram |
| 2011/0192067 | A1 | 8/2011 | Troy |
| 2011/0258899 | A1 | 10/2011 | Fitzpatrick et al. |
| 2012/0000108 | A1 | 1/2012 | Zusman |
| 2012/0042556 | A1 | 2/2012 | Vesligaj |
| 2012/0079752 | A1 | 4/2012 | Peterson et al. |
| 2012/0131829 | A1 | 5/2012 | Fistikchi |
| 2012/0174455 | A1 | 7/2012 | Edelman et al. |
| 2012/0174456 | A1 | 7/2012 | DePierro et al. |
| 2012/0174457 | A1 | 7/2012 | Edelman |
| 2012/0180353 | A1 | 7/2012 | Holmberg |
| 2013/0180148 | A1 | 7/2013 | Rodgers et al. |
| 2013/0305579 | A1 | 11/2013 | Ward et al. |
| 2014/0075815 | A1* | 3/2014 | Jarboe ..... F41C 23/14 42/73 |
| 2014/0223791 | A1 | 8/2014 | Ruby et al. |
| 2015/0176943 | A1 | 6/2015 | Iervolino |
| 2016/0116249 | A1 | 4/2016 | Maugham |
| 2016/0178314 | A1 | 6/2016 | Kielsmeier et al. |
| 2016/0202016 | A1* | 7/2016 | Mather ..... F41C 23/14 42/73 |
| 2016/0258713 | A1 | 9/2016 | Huang et al. |
| 2016/0273876 | A1 | 9/2016 | Barfoot et al. |
| 2016/0305738 | A1 | 10/2016 | Huang et al. |
| 2016/0327361 | A1 | 11/2016 | Roberts et al. |
| 2016/0341518 | A1 | 11/2016 | Barfoot et al. |
| 2016/0363415 | A1 | 12/2016 | Kielsmeier et al. |
| 2017/0010065 | A1 | 1/2017 | Kielsmeier et al. |
| 2017/0082394 | A1 | 3/2017 | Chow et al. |
| 2017/0241737 | A1 | 8/2017 | Keller, II |
| 2018/0003459 | A1 | 1/2018 | Miller et al. |
| 2019/0128639 | A1 | 5/2019 | Parker et al. |

* cited by examiner

FIG. 34
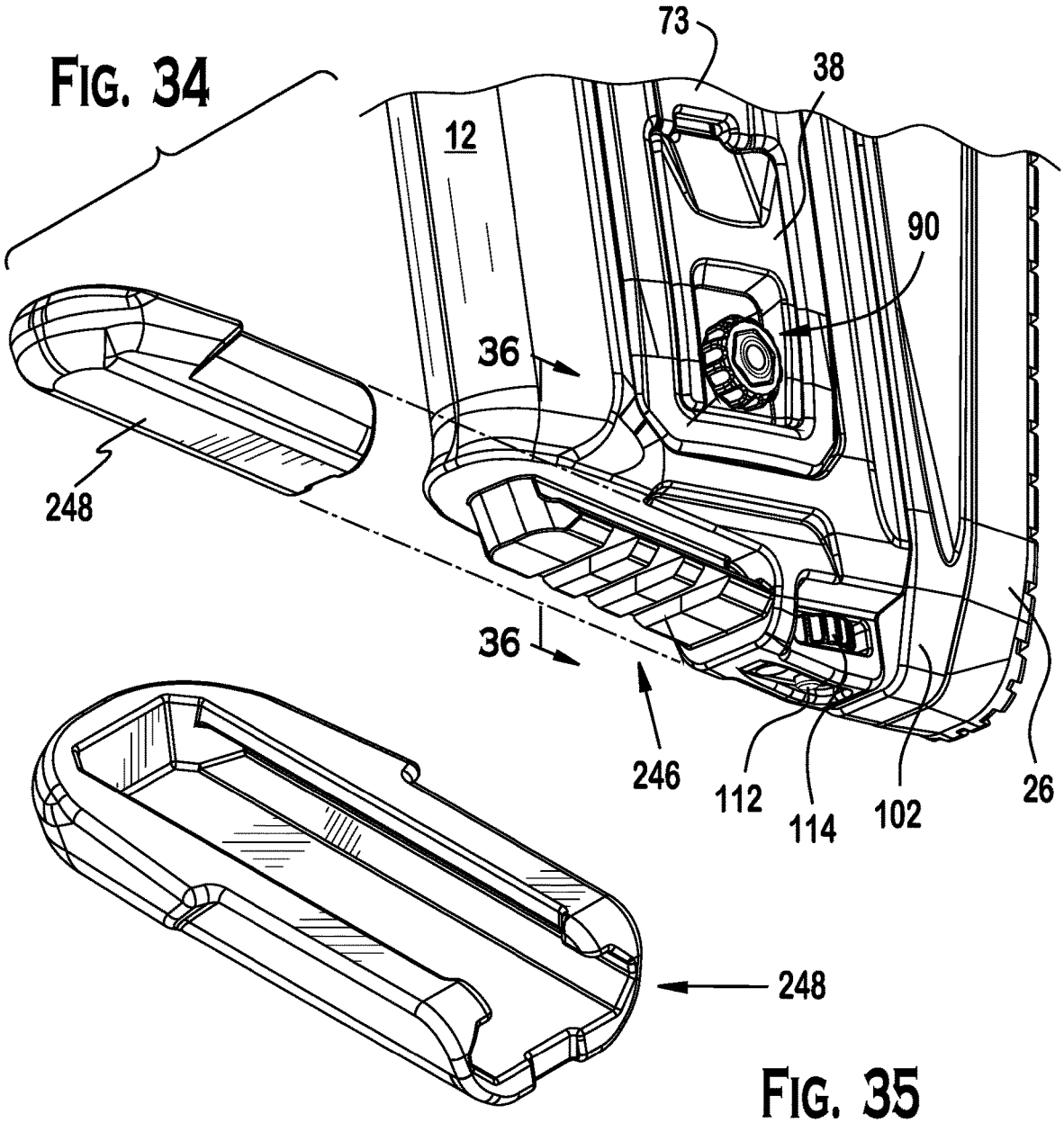
FIG. 35
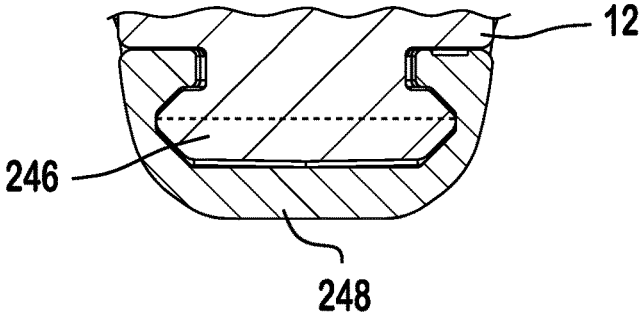
FIG. 36

VARIABLY ADJUSTABLE STOCK FOR A GUN AND APPARATUS AND METHOD FOR ADJUSTMENT OF SAME

CROSS REFERENCE TO RELATED APPLICATIONS

This application claims the benefit of U.S. Provisional Application No. 62/890,362 filed Aug. 22, 2019. Also, this application is a continuation-in-part of U.S. patent application Ser. No. 29/698,414 filed Jul. 16, 2019. These applications are incorporated by reference herein in their entirety.

FIELD OF THE INVENTION

The invention generally relates to a stock for a small arms weapon. More particularly, the invention relates to a variably adjustable butt stock for a firearm.

BACKGROUND

Stabilizing accessories for firearms are known in the related art. These accessories may be used to provide support for a firearm and may facilitate enhanced accuracy of the weapon during operation.

SUMMARY

Hence, a variably adjustable stock for a gun is disclosed. The stock may include a butt stock body. The butt stock body may include a first longitudinal axis as well as a proximal end, a distal end spaced from the proximal end along the first longitudinal axis, and a butt plate receptacle. The butt plate receptacle may be situated adjacent to the proximal end. The stock may further include a butt plate assembly positioned in the butt plate receptacle, a cheek piece abutting the butt stock body and the butt plate assembly, and a clamp. The clamp may include first and second configurations such that in the first configuration the clamp permits independent movement of the butt plate assembly and the cheek piece relative to the butt stock body. In the second configuration, the clamp may fix movement of the butt plate assembly and the cheek piece relative to the butt stock body. For instance, in the second configuration, the cheek piece may be clamped against the butt stock body and the butt plate assembly.

The butt plate receptacle may be housed in the butt stock body. The butt plate receptacle may extend from the proximal end of the butt stock body toward the distal end of the butt stock body. Additionally, the butt plate receptacle may include a port side butt plate receptacle sidewall, a starboard side butt plate receptacle sidewall, and a lower rail receiving track disposed between the port side butt plate receptacle sidewall and the starboard side butt plate receptacle sidewall. The port side butt plate receptacle sidewall further may include a port side upper stop, a port side lower stop, and a port side opening. Similarly, the starboard side butt plate receptacle sidewall may include a starboard side upper stop, a starboard side lower stop, and a starboard side opening. Also, the butt plate receptacle may include a butt plate travel adjustment mechanism. The butt plate travel adjustment mechanism may include a screw and an adjustment knob. The adjustment knob may be disposed at an acute angle with respect to the lower rail receiving track and may be connected to the screw by a mating screw thread such that rotation of the adjustment knob in a first direction advances the screw into the lower rail receiving track to selectively limit rearward travel of the butt plate assembly.

Additionally, the butt plate assembly may include a butt plate, a butt pad, and a cover plate disposed between the butt pad and the butt plate. The butt pad may include a butt plate fastener hole. The butt plate fastener hole may be of an elongated shape having a first major axis, the first major axis being perpendicular to the first longitudinal axis.

Further, the butt plate assembly may include a frame adjacent to the butt plate. The frame may include an upper rail. The upper rail may include a port side fluted upper rail face, a starboard side fluted upper rail face, a comb portion positioned between the port side fluted upper rail face and the starboard side fluted upper rail face, and a spring guide projecting from the comb portion. The frame may further include a lower rail. The lower rail may include a port side fluted lower rail face and a starboard side fluted lower rail face. Also, the frame may include a front rail which connects the upper rail and the lower rail. The frame further may include a passage located between the upper rail and the lower rail.

The butt plate assembly may further include a port side clamping plate. The port side clamping plate may include a first exterior oriented face and a first interior oriented face. The first interior oriented face may include a first grooved portion. The first grooved portion may be configured and dimensioned to engage with the port side fluted upper rail face. Also, the port side clamping plate may include a first elongated slot which extends from the first exterior oriented face to the first interior oriented face. Moreover, the butt plate assembly may include a starboard side clamping plate. The starboard side clamping plate may include a second exterior oriented face and a second interior oriented face. The second interior oriented face may include a second grooved portion. The second grooved portion may be configured and dimensioned to engage with the starboard side fluted upper rail face. Also, the starboard side clamping plate may include a second elongated slot, the second elongated slot being disposed opposite to the first elongated slot.

The port side clamping plate and the starboard side clamping plate may be juxtaposed, and the frame may be positioned between the port side clamping plate and the starboard side clamping plate. A first spring may be situated between the port side clamping plate and the starboard side clamping plate. The frame, the port side clamping plate, and the starboard side clamping plate may be positioned in the butt plate receptacle, and the first spring may bias the port side clamping plate and the starboard side clamping plate away from the frame. The butt stock assembly further may include a second spring that is positioned around the spring guide. The second spring may bias the frame away from the distal end of the butt stock body.

Furthermore, the cheek piece may include a cheek rest, a first cheek rest riser connected to the cheek rest, and a second cheek rest riser connected to the cheek rest. Additionally, the clamp may include an eccentric lever positioned adjacent to the first cheek rest riser, an anchor positioned adjacent to the second cheek rest riser, and a locking rod. The locking rod may be arranged through the butt plate receptacle and the butt plate assembly. The locking rod may be connected to the eccentric lever and the anchor such that in the second configuration the eccentric lever forms a first clamping member and the anchor forms a second clamping member for fixing movement of the butt plate assembly and the cheek piece relative to the butt stock body.

An apparatus and method are disclosed in which the clamp may be assembled within the stock body to provide for variable adjustment of the butt stock with a dominant hand on the firearm grip, as well as providing for variable adjustment of a butt stock with a nondominant hand. Similarly, a modular stock and one or more adaptors are disclosed which may be packaged as a kit for selectively assembling a left dominant hand configuration of a variably adjustable stock or a right dominant hand configuration of a variably adjustable stock, alone or with one or more adaptors for use with a specific firearm or receiver extension.

DESCRIPTION OF THE DRAWINGS

In the accompanying drawings, which form part of this specification and are to be read in conjunction therewith and in which like reference numerals are used to indicate like parts in the various views:

FIG. 34 is a partially exploded view of the butt stock body showing an integrally formed accessory mounting rail on the bottom of the butt stock, along with a removable cover that may be used to enclose the accessory rail when not in use.

FIG. 35 is a rear, right side, top perspective view of the removable cover of FIG. 34;

FIG. 36 is a partial sectional view of the butt stock body of FIG. 34 along line 36-36.

DESCRIPTION

Figure 1:
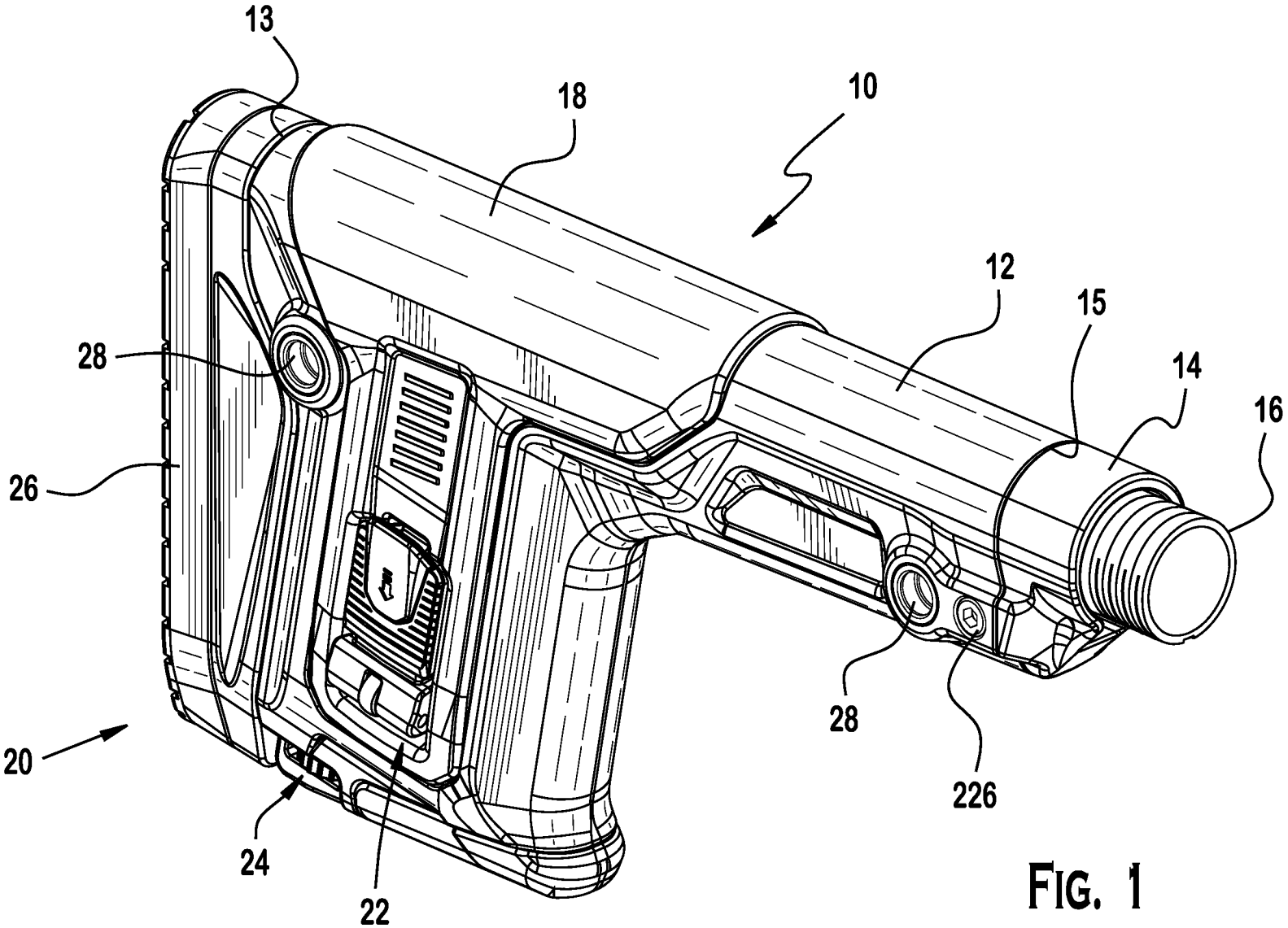
FIG. 1 is perspective view of an exemplary stock for a small arms weapon.
Figure 2:
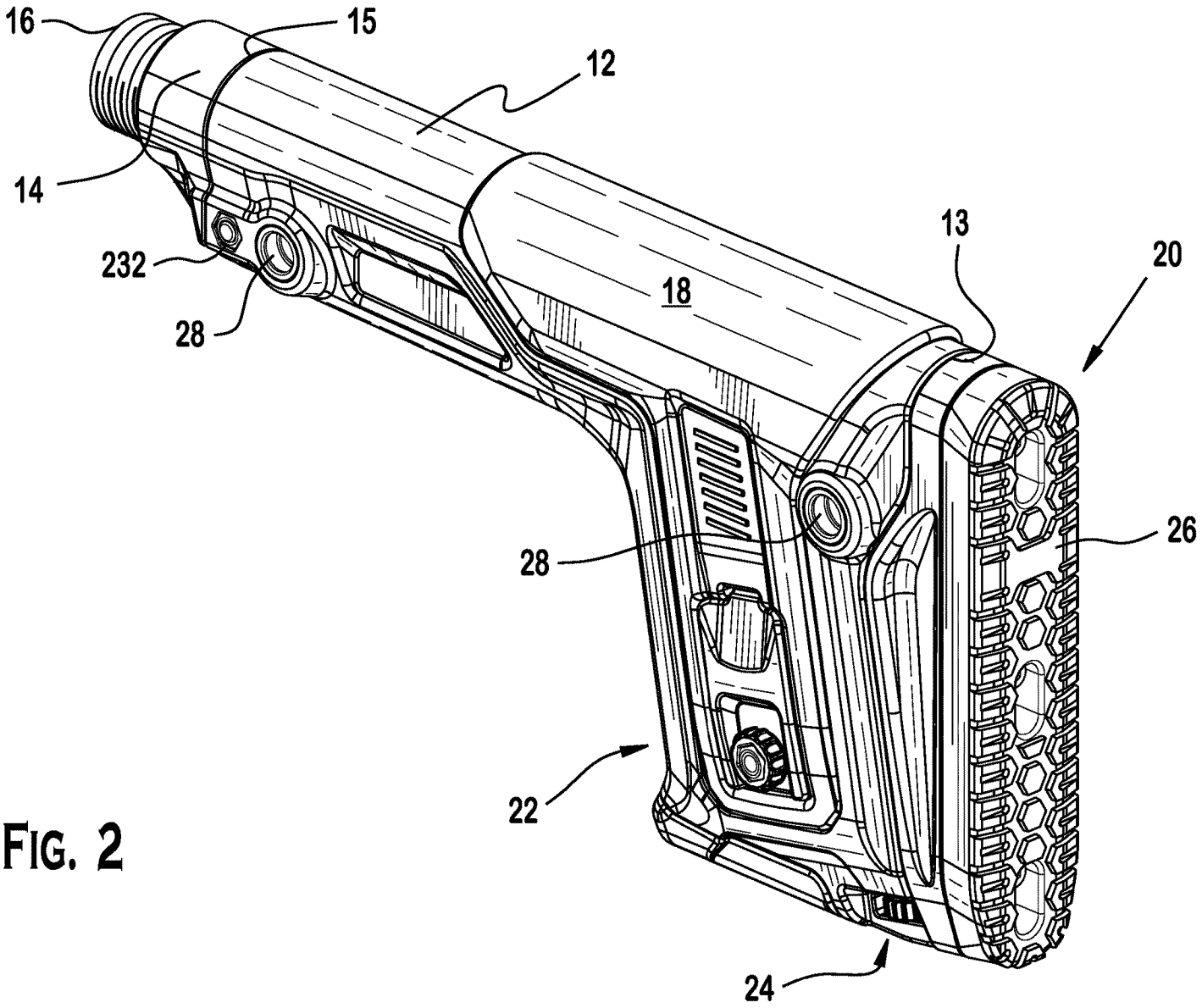
FIG. 2 is a rear, right, top perspective view of the stock of FIG. 1.

FIG. 1 and FIG. 2 depict an exemplary butt stock 10 for a long arm. The butt stock 10 may include a butt stock body 12 having a proximal end 13 and a distal end 15. The butt stock may further include a cheek piece 18 and a butt plate assembly 20. The butt plate assembly 20 may include a rubber or rubberized butt pad 26. The position of the butt pad 26 may be adjustable vertically as well. The butt stock may further include a first variable adjustment regulation system 22 for selectively and independently configuring the respective positions of the butt plate assembly and the cheek piece. Moreover, the butt stock 10 may include a second variable adjustment regulation assembly 24 for regulating displacement of the butt plate assembly. The butt stock body 12 further may include a quick disconnect mount (QD mount) near the proximal end 13, as well as a QD mount near the distal end 15. Additionally, the butt stock body 12 may be of a modular design which may connect with an adaptor 14 for a specific firearm type or manufacture. The adaptor 14 may be secured to the distal end 15 of the butt stock body 12, as well as to a receiver extension 16 of a firearm.

Figure 4:
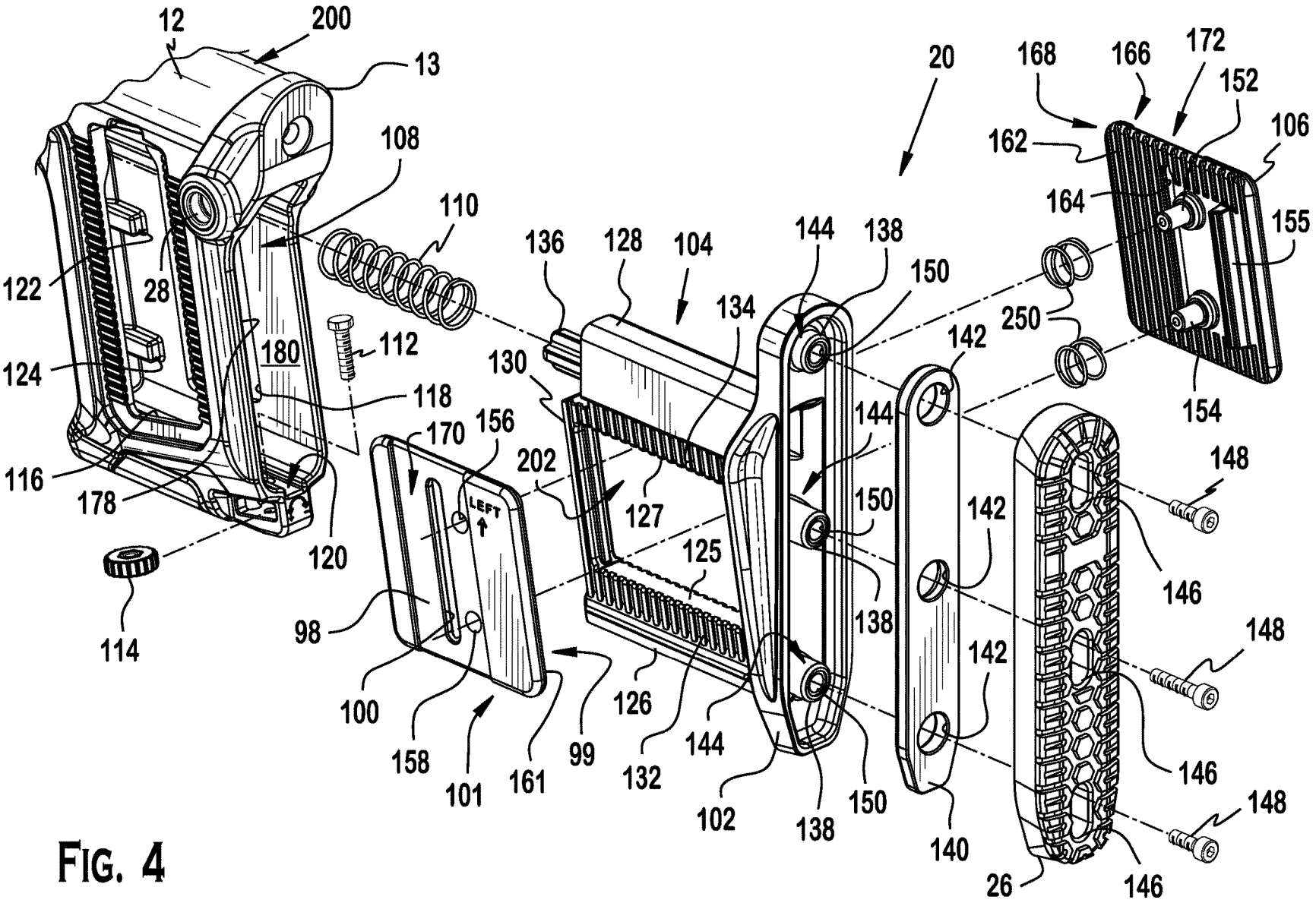
FIG. 4 is an exploded view of the butt plate assembly of FIG. 1.

Referring to FIG. 4, the butt stock body 12 may include a butt plate receptacle 108. The butt plate receptacle 108 may be situated adjacent to the proximal end 13 of the butt stock body 12. For example, the butt plate receptacle 108 may be housed in the butt stock body 12 and may extend from the proximal end 13 toward the distal end 15. The butt plate receptacle 108 may include a port side sidewall 178 and a starboard side sidewall 180. Additionally, the butt plate receptacle 108 may include a lower rail receiving track 120 between the port side sidewall 178 and the starboard side sidewall 180. The butt plate receptacle further may include a starboard side upper stop 122, a starboard side lower stop 124, and a starboard side opening 118.

Figure 6:
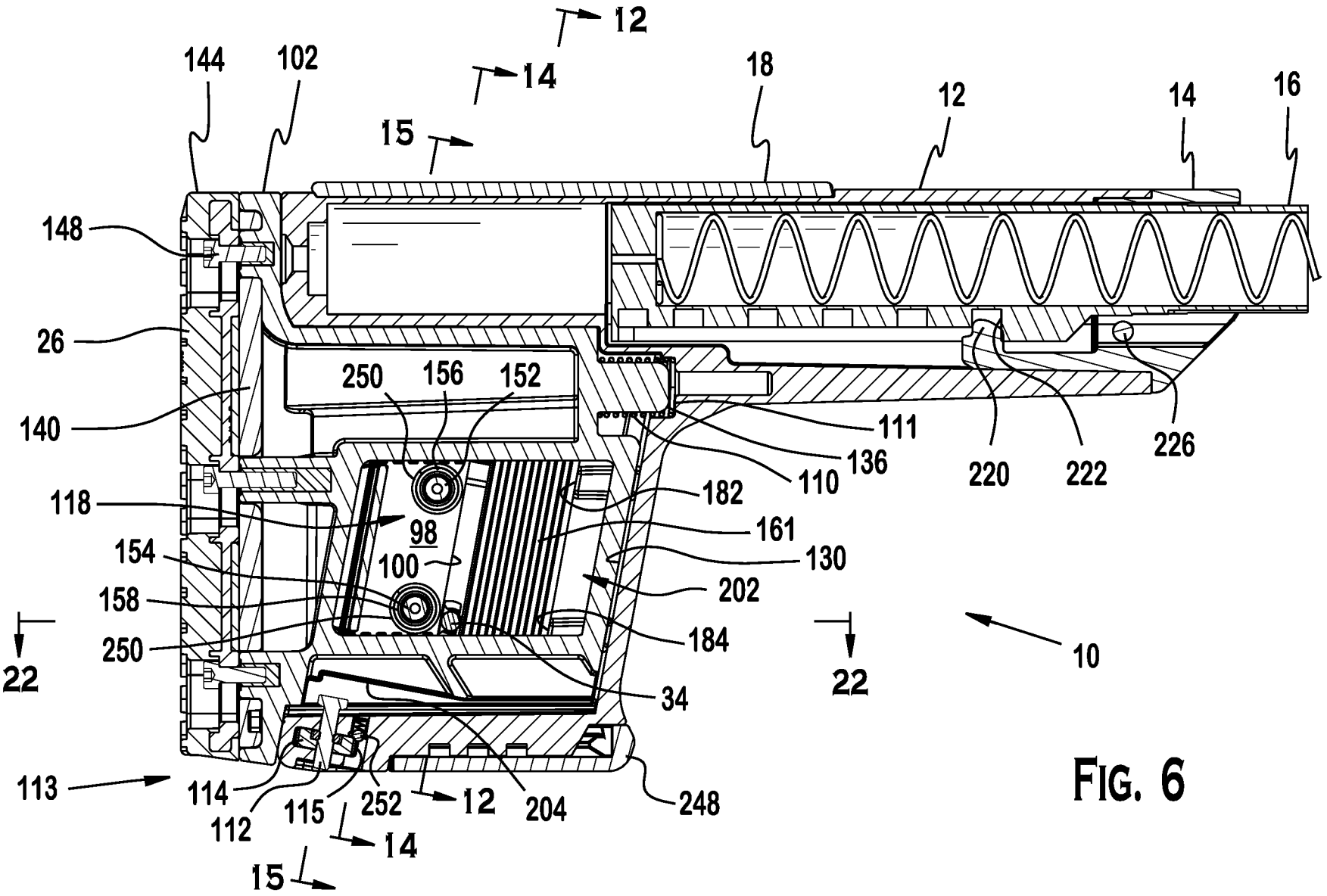
FIG. 6 is cross-sectional view of the stock of FIG. 5 along line 6-6.

As shown in FIG. 6, the butt plate receptacle 108 further may include a port side upper stop 182, a port side lower stop 184, and a port side opening 118. Moreover, the butt stock body 12 may include a butt plate travel adjustment mechanism 113 which interacts with the frame 108 to selectively regulate rearward travel of the butt plate assembly 20, lower rail receiving track 120. For example, the butt plate travel adjustment mechanism 113 may include a screw 112 and an adjustment knob 114 adjacent to the lower rail receiving track 120. More particularly, the adjustment knob 114 may be disposed at an angle with respect to the lower rail receiving track 120 and connected to the screw 112 by a mating screw thread. Rotation of the adjustment knob 114 in one direction may advance the screw into the lower rail receiving track 120 and counter rotation of the adjustment knob may retract the screw.

Figure 3:
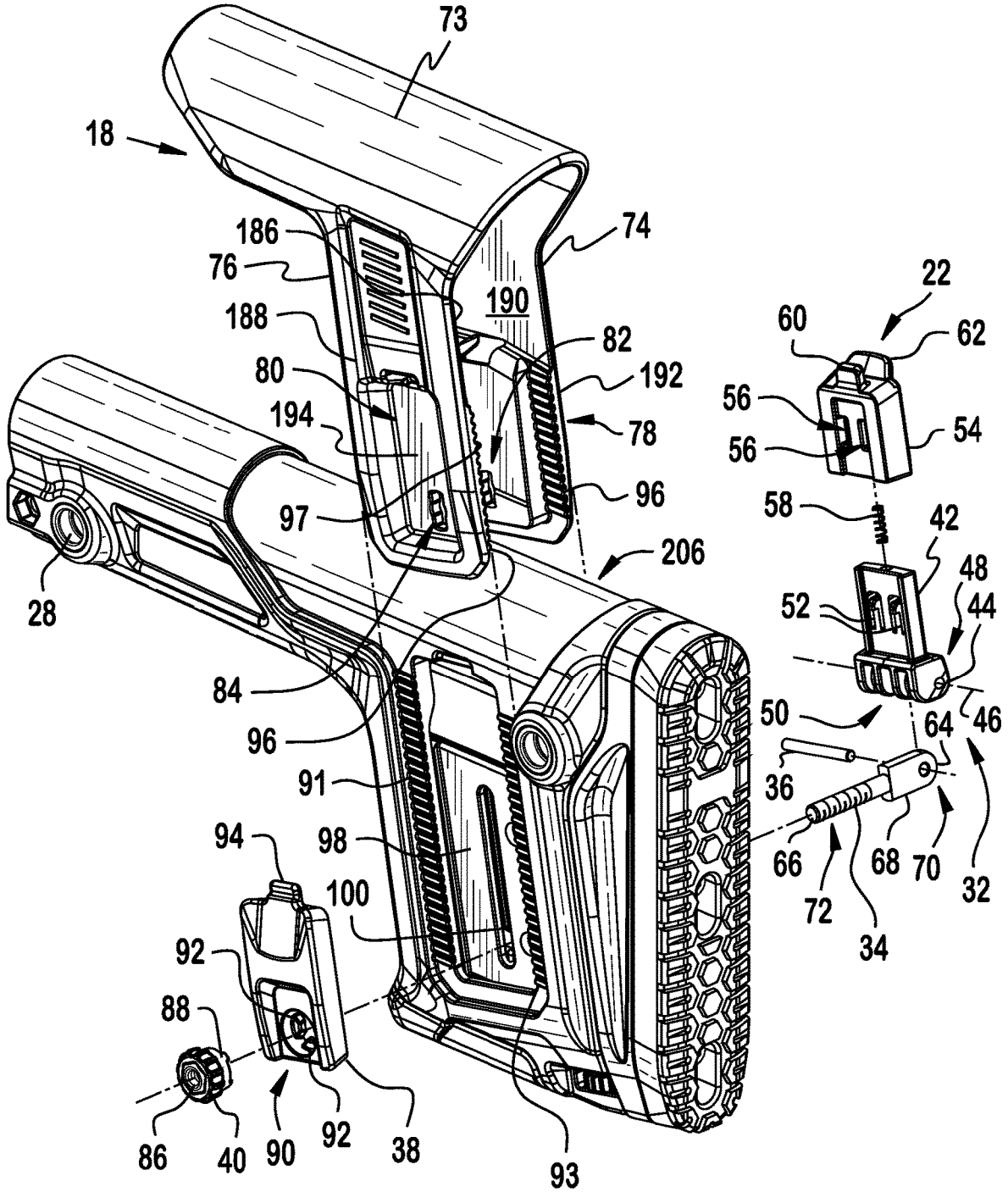
FIG. 3 is an exploded view of the cheek piece and clamp of FIG. 1.

Referring to FIG. 3, the butt stock body 12 further may include a cheek piece shaped recess 206 which is configured and dimensioned to receive the cheek piece 18. Additionally, the butt stock body may include a port side opening 116 and a starboard side opening 118. See e.g., FIG. 4. The port side opening 116 may extend from the port sidewall 178 of the butt plate receptacle 108 to the port side of the cheek piece recess 206. The port side of the cheek piece recess 206 further may include proximal and distal horizontally fluted tracks 91, 93. Similarly, the starboard side opening 118 may extend from the starboard sidewall 180 of the butt plate receptacle 108 to the starboard side of the cheek piece recess 206. Also, the starboard side of the cheek piece recess 206 may include proximal and distal horizontally fluted tracks 101, 103. See e.g., FIG. 10.

Referring to FIG. 1 and FIG. 2, the butt stock body 12 further may include a quick disconnect mount (QD mount) near the proximal end 13, as well as a QD mount near the distal end 15. Moreover, the butt stock may be a modular design that includes an adaptor 14 for a specific firearm type or manufacture. The adaptor 14 may be secured to the distal end 15 of the butt stock body 12, as well as to a receiver extension 16 of a firearm.

Referring to FIG. 4, the butt plate assembly 20 may include a butt plate 102, a frame 104, a port side clamping plate 98, a starboard side clamping plate 106, and an axially oriented compression spring 110. The butt pad 26 may be positioned against a cover plate 140 and secured to the butt plate. For example, the butt plate may include one or more cylindrical projections 144 which possess a side wall 138 that is configured and dimensioned to serve as a mount for a mating hole 142 in the cover plate 140. The one or more of the cylindrical projections 138 further may include a threaded bore 150. The one or more threaded bores 150 may be configured and dimensioned to releasably mate with a corresponding socket head screw 148 or another suitable fastener. Additionally, the butt plate assembly 20 further may include one or more transversely oriented compression springs (not shown) which may be positioned between the port side clamping plate 98 and the starboard side clamping plate 106. For example, one transversely oriented compression spring may be mounted on an upper transverse member 152 located on the starboard side clamping plate 106. Similarly, another transversely oriented compression spring may be mounted on a lower transverse member 154 located on the starboard side clamping plate 106.

Figure 16:
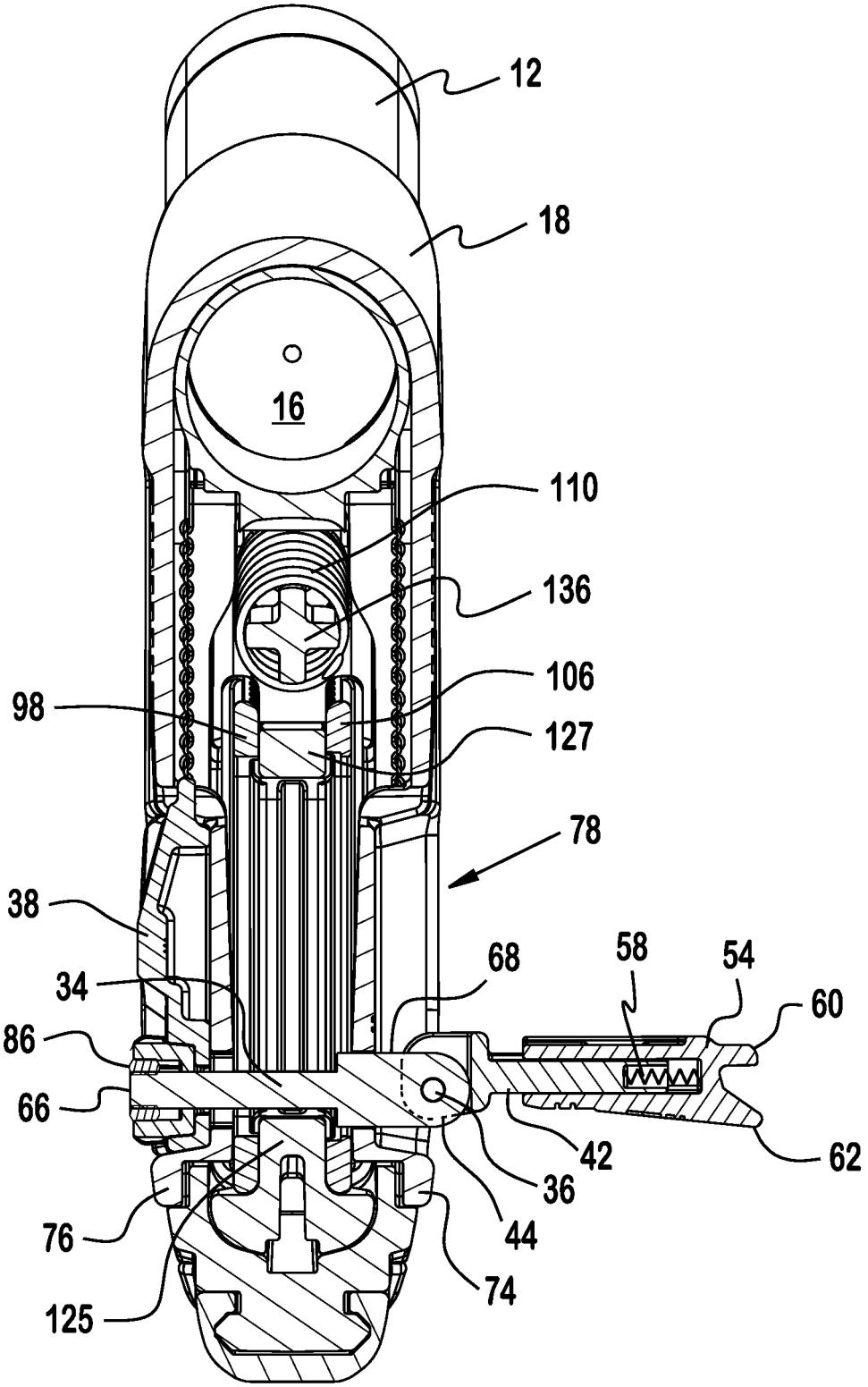
FIG. 16 is cross-sectional view of the stock of FIG. 8 along line 16-16.
Figure 17:
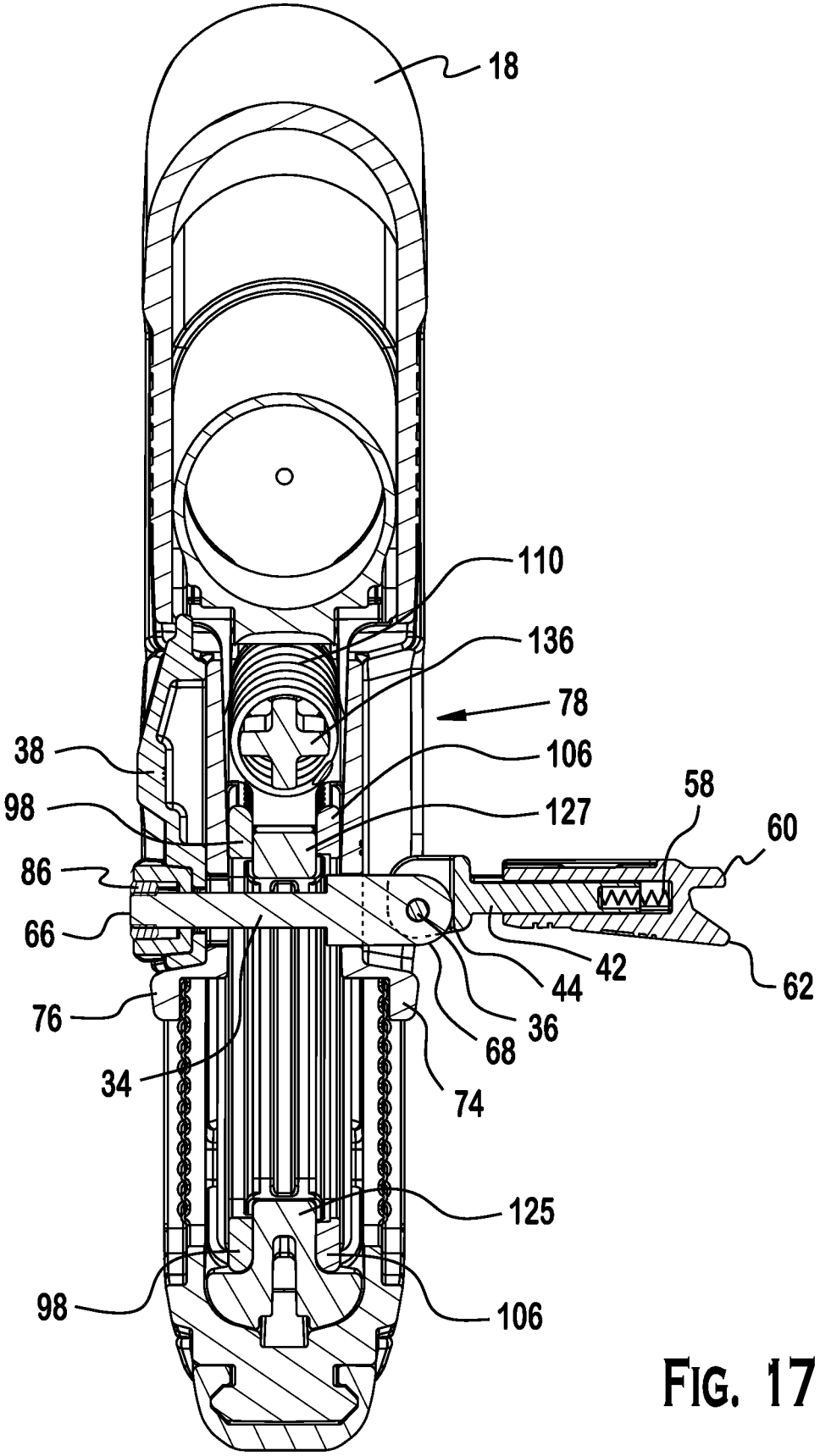
FIG. 17 is cross-sectional view of the stock of FIG. 9 along line 17-17.
Figure 18:
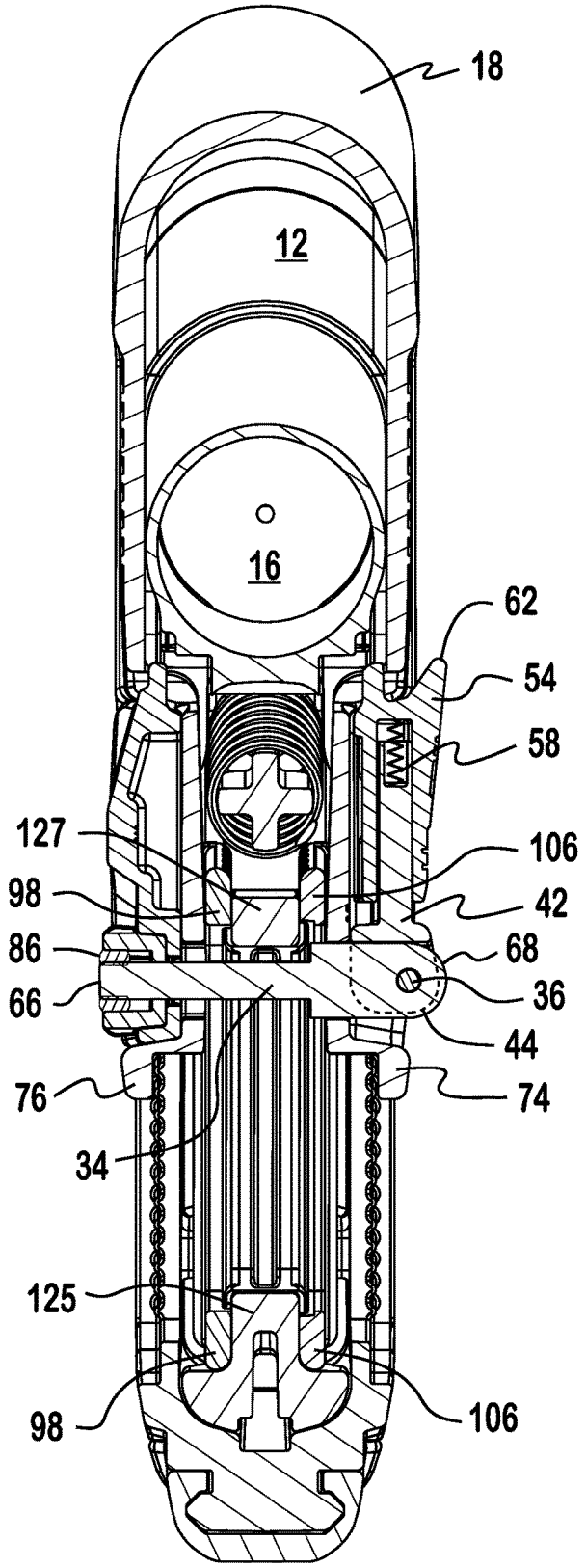
FIG. 18 is cross-sectional view of the stock of FIG. 11 along line 18-18.

The butt plate 102 may be secured to or integrally formed with the frame 104. The frame 104 may include an upper rail 127 and a lower rail 125. A front rail 130 may connect the upper rail 127 to the lower rail 125 near the distal end of the frame. The upper rail 127 further may include a port side fluted upper rail face 134 and a starboard side fluted upper rail face 135 (see e.g., FIG. 7). Similarly, the lower rail 125 may include a port side fluted lower rail face 132 and a starboard side fluted lower rail face 137 (see e.g., FIG. 7). The lower rail may include a base 126. The upper rail further may include a comb 128. Referring to FIG. 16, a spring guide 136 may projects axially away from the comb. As shown in FIG. 4, the frame 104 may further include a passage 202 located between the upper rail 127 and the lower rail 125. Further, the passage 202 may be located between the butt plate 102 and the front rail 105. The passage 202 may have rectangular shape.

The port side clamping plate 98 and the starboard side clamping plate 106 may each include an elongated slot 100, 164. Further, the port side clamping plate 98 and the starboard side clamping plate 106 may each include an interior oriented face 99, 168 and an exterior oriented face 101, 166. The respective interior oriented faces 99, 168 may include a clamp face having a plurality of grooves 161, 162. The plurality of grooves 161, 162 may be in parallel alignment. Further, the plurality of grooves 161, 162 may be in parallel alignment with the elongated slots 100, 164. The respective interior oriented faces 99, 168 may each further include a spacer 153, 155. Additionally, the exterior oriented faces 101, 166 may include a recess 170, 172 and the elongated slots 100, 164 may each intersect the base of the recess 170, 172. Moreover, the port side clamping plate 98 may include an upper transverse member receiving hole 156 and a lower transverse member receiving hole 158.

The port side clamping plate 106 and the starboard side clamping plate may be juxtaposed, and the frame 104 may be positioned between them. The interior oriented faces 99, 168 may be positioned opposite the upper rail 127 and a lower rail 125 of the frame. The elongated slots 100, 164 may be aligned. The upper transverse member 152 and the lower transverse member 154 may be positioned in the passage 202 and received respectively by the upper transverse member receiving hole 156 and the lower transverse member receiving hole 158. A transversely oriented compression spring may be mounted on the upper transverse member 152 and/or lower transverse member 154 to bias the port side clamping plate 106 and the starboard side clamping plate away from the frame. Preferably, however, one transversely oriented compression spring may be mounted on the upper transverse member 152 and another transversely oriented compression spring may be mounted on the lower transverse member 154 to bias the port side clamping plate 106 and the starboard side clamping plate away from the frame. Nevertheless, a transversely oriented compression spring may not be included. For example, a transversely oriented compression spring may not be necessary where the cheek piece is formed from a resilient material such that the cheek rest risers are constructed to be biased outwardly. In another example, a transversely oriented compression spring may not be desirable in order to enhance tactile feedback to an operator when adjusting trigger pull length. Generally, however, the port side fluted upper and lower rail faces 132, 134 may be positioned opposite the plurality of grooves 161 located on the port side clamping plate, and the starboard side fluted upper and lower rail faces 135, 137 may be positioned opposite the plurality of grooves 162 located on the starboard side clamping plate 106.

Figure 8:
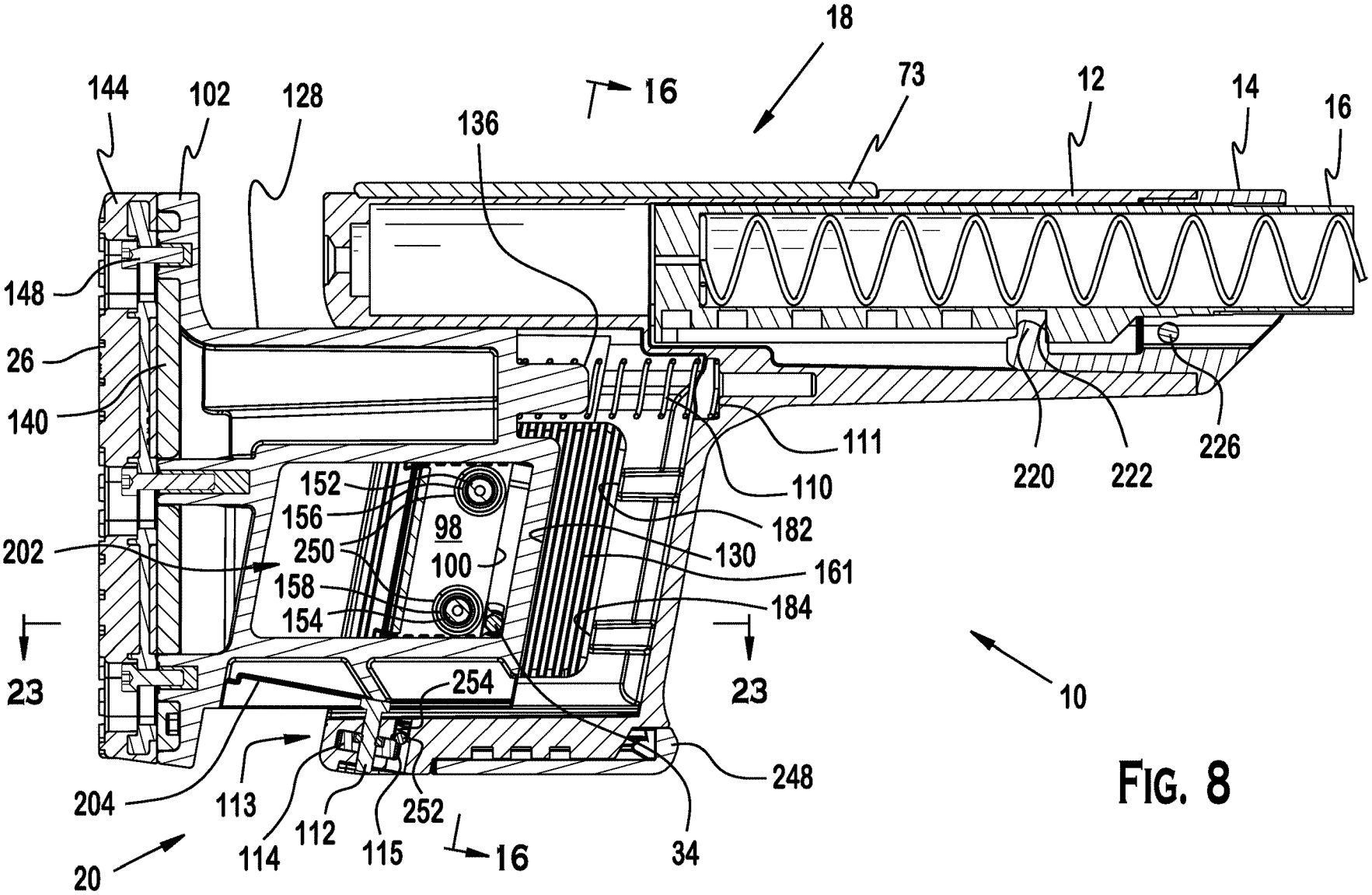
FIG. 8 is cross-sectional view of the stock of FIG. 7 along line 8-8.
Figure 23:
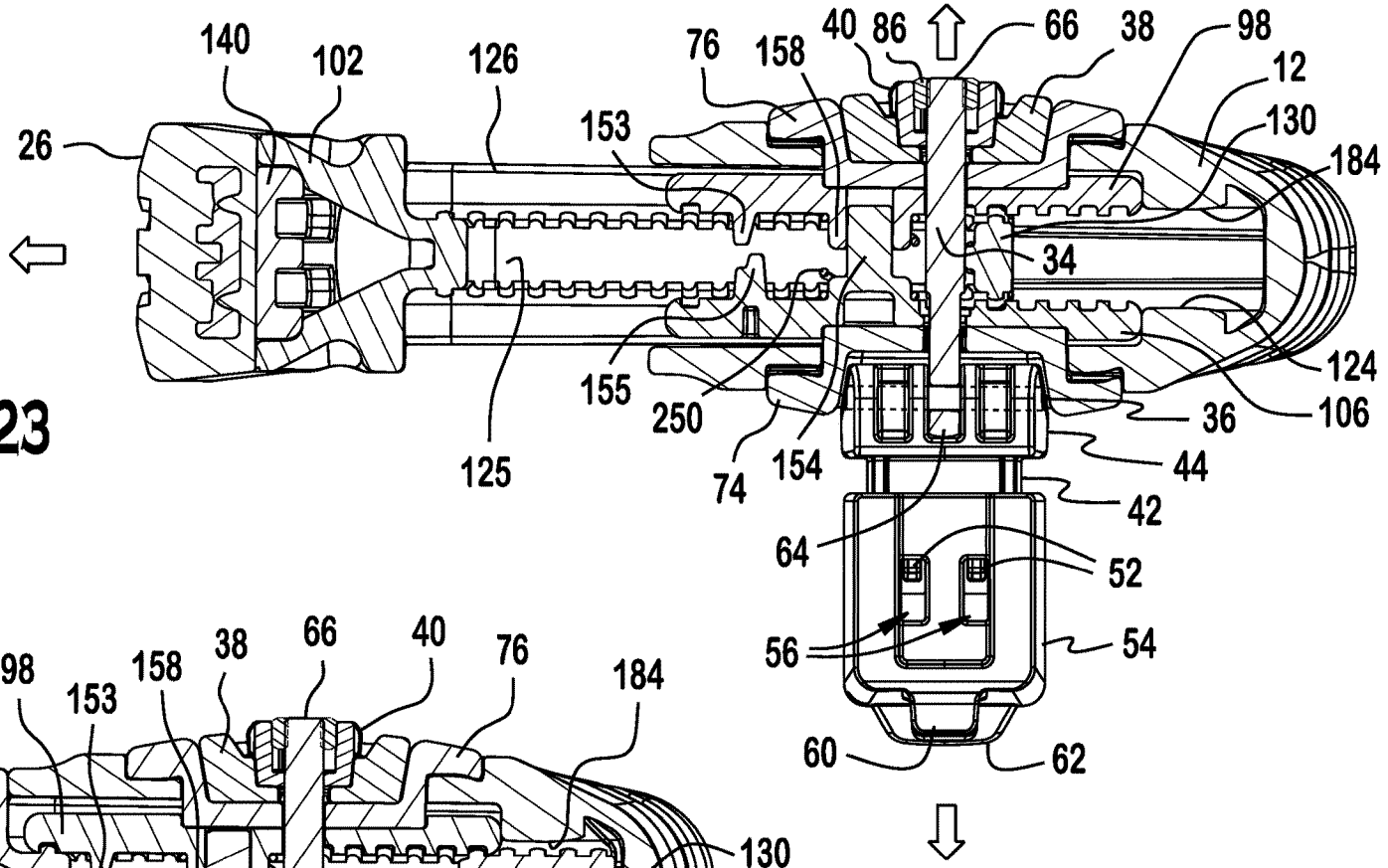
FIG. 23 is cross-sectional view of the stock of FIG. 8 along line 23-23.
Figure 22:
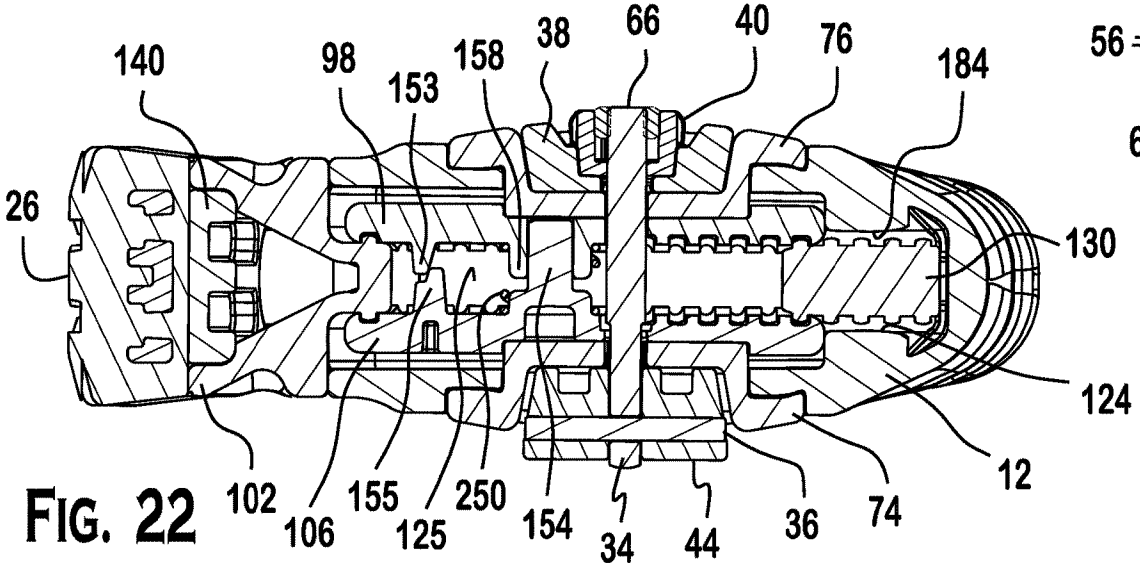
FIG. 22 is cross-sectional view of the stock of FIG. 6 along line 22-22.

The frame 104 may be slidably received in the butt plate receptacle 108. As shown in FIGS. 6 and 8, the port side clamping plate 98 abuts the port side upper stop 182 and the port side lower stop 184 when the stock is in the collapsed position or in an extended position. Additionally, the starboard side clamping plate 106 abuts the starboard side lower stop 124 when the stock is in the collapsed position (e.g., FIG. 22) or in an extended position (e.g., FIG. 23). By contrast, the screw 112 of the butt plate travel adjustment mechanism 113 may contact a lower surface 208 of the frame to block movement of the frame axially in the proximal direction of the butt stock body 12. See e.g., FIG. 8. For example, the lower surface may be disposed and an acute angle with respect to the screw 112 and lower rail receiving track 120 such that movement of the frame axially in the proximal direction of the butt stock body 12 is progressively limited as the screw is advanced toward the lower surface 204. Moreover, as shown in FIG. 6 and FIG. 8, the spring 110 may be compressed between the comb 128 and end wall 111 of the butt plate receptacle 108 to spring load the frame 104.

Referring to FIG. 3, the cheek piece 18 may include a cheek rest 73, a port side cheek rest riser 76 connected to the cheek rest, and a starboard side cheek rest riser 74 connected to the cheek rest. The port side cheek rest riser 76 may include a first inner surface 186 facing the starboard side cheek rest riser 74, a first outer surface 188 facing away from the starboard side cheek rest riser 74, and a port side clamp receptacle 80 extending from the first outer surface 188 to a first end wall 194 located between the first inner surface 186 and the first outer surface 188. The first end wall 194 may further include a first aperture 84 which extends from the first end wall 194 to the first inner surface 186. Similarly, the starboard side cheek rest riser 74 may include a second inner surface 190 facing the starboard side cheek rest riser 74, a second outer surface 192 facing away from the starboard side cheek rest riser 74, and a starboard side clamp receptacle 78. The starboard side clamp receptacle 78 may extend from the outer surface 192 to a second end wall 196 located between the second inner surface 190 and the second outer surface 192. The second end wall 196 may include a second aperture which extends from the second end wall 196 to second inner surface 190. Moreover, the first inner surface 186 of the port side cheek rest riser 76 may include a horizontally fluted track 97, and the second inner surface 190 of the starboard side cheek rest riser 74 may include a horizontally fluted track 96.

Figure 12:
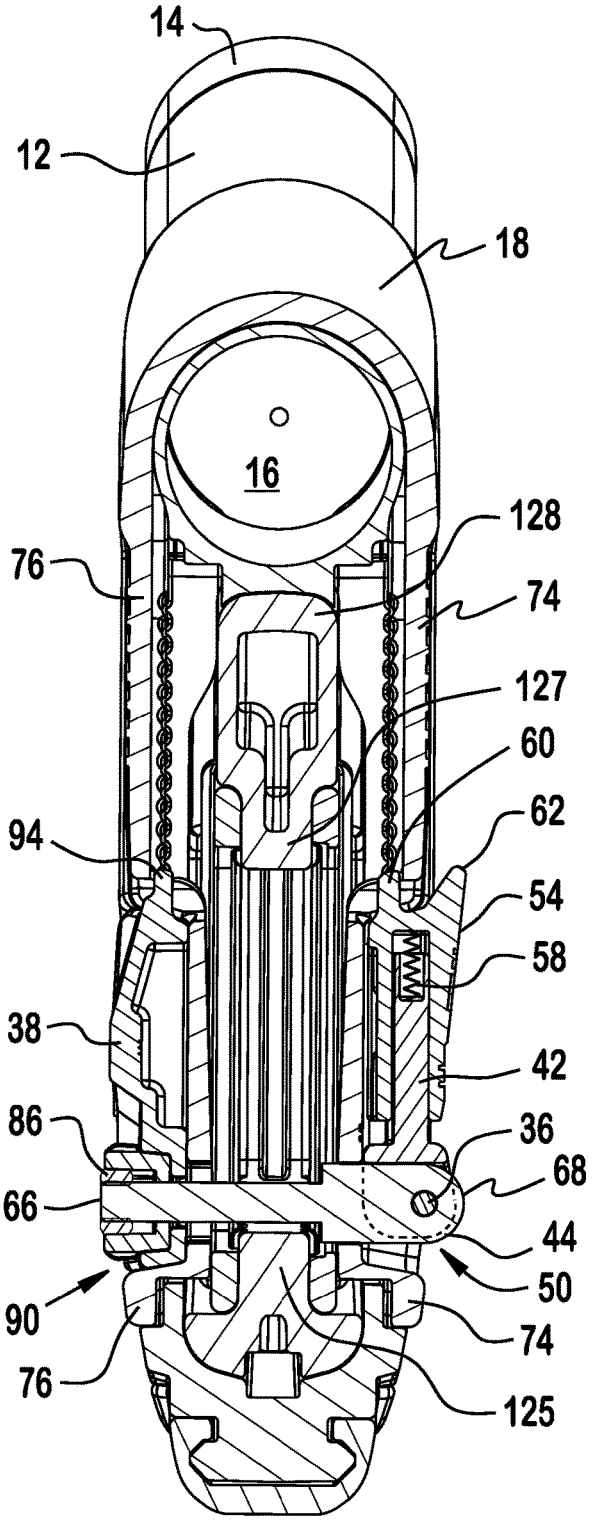
FIG. 12 is cross-sectional view of the stock of FIG. 6 along line 12-12.

The butt stock 10 may further include a clamp 30. The clamp 30 may include an eccentric lever 32, a locking rod 34, and an anchor 38. Referring to FIG. 12, the butt stock 10 may be assembled with the eccentric lever 32 positioned in the starboard side clamp receptacle 78 and the anchor positioned in the port side clamp receptacle 80. In this configuration, the butt stock 10 may be adapted for use by an operator having a dominant right hand (e.g., a right handed shooter). By contrast, in FIG. 13, the butt stock 10 may be assembled with the eccentric lever 32 positioned in the port side clamp receptacle 80 and the anchor positioned in the starboard side clamp receptacle 78. In this configuration, the butt stock 10 may be adapted for use by an operator having a dominant left hand (e.g., a left handed shooter).

In FIG. 3, the eccentric lever 32 may include an eccentric portion 44 including a third longitudinal axis 46. Further, the eccentric portion may include a bore 48 extending along the third longitudinal axis 46, and a locking rod receptacle 50 which intersects the bore 48. The eccentric portion further may include a lever arm 42 connected to the eccentric portion 44. The lever arm 42 may include a plurality of resilient hooks 52. Moreover, the eccentric portion may include a latch housing 54. The latch housing 54 may be disposed over the lever arm 42. The latch housing further may include a plurality of rectangular openings which are configured and dimensioned to form a sliding press fit connection with the plurality of resilient hooks 52. The latch housing 54 may include a latch 60, and a tab 62 offset from the latch. A compression spring 58 further may be positioned between the lever arm 42 and the latch housing 54. The compression spring 58 may bias the latch housing 54 away from the lever arm 42. Additionally, the locking rod may include a proximal end 64 and a distal end 66. The proximal end 64 of the locking rod may include a head 68. The head 68 may include a through hole 70. The distal end of the locking rod may be opposite to the proximal end 64. The locking rod 34 may further include a screw thread 72 adjacent to the distal end 66. The anchor may include a nut receiving receptacle 90, a locking rod receiving bore 198, and a flange 94. Also, the clamp may further include pin 36 and a nut 40. The nut may include a threaded bore 200. The head 68 of the locking rod 34 may be disposed in the locking rod receptacle 50, and the pin 36 may be positioned in the bore 48 of the eccentric portion 44 and the through hole 70 in the head 68 of the locking rod 34. Further, the nut 40 may be positioned in the nut receiving receptacle 90 of the anchor, and the screw thread 72 adjacent the distal end of the locking rod 34 may be mated with the screw thread 200 of the nut 40.

Figure 5:
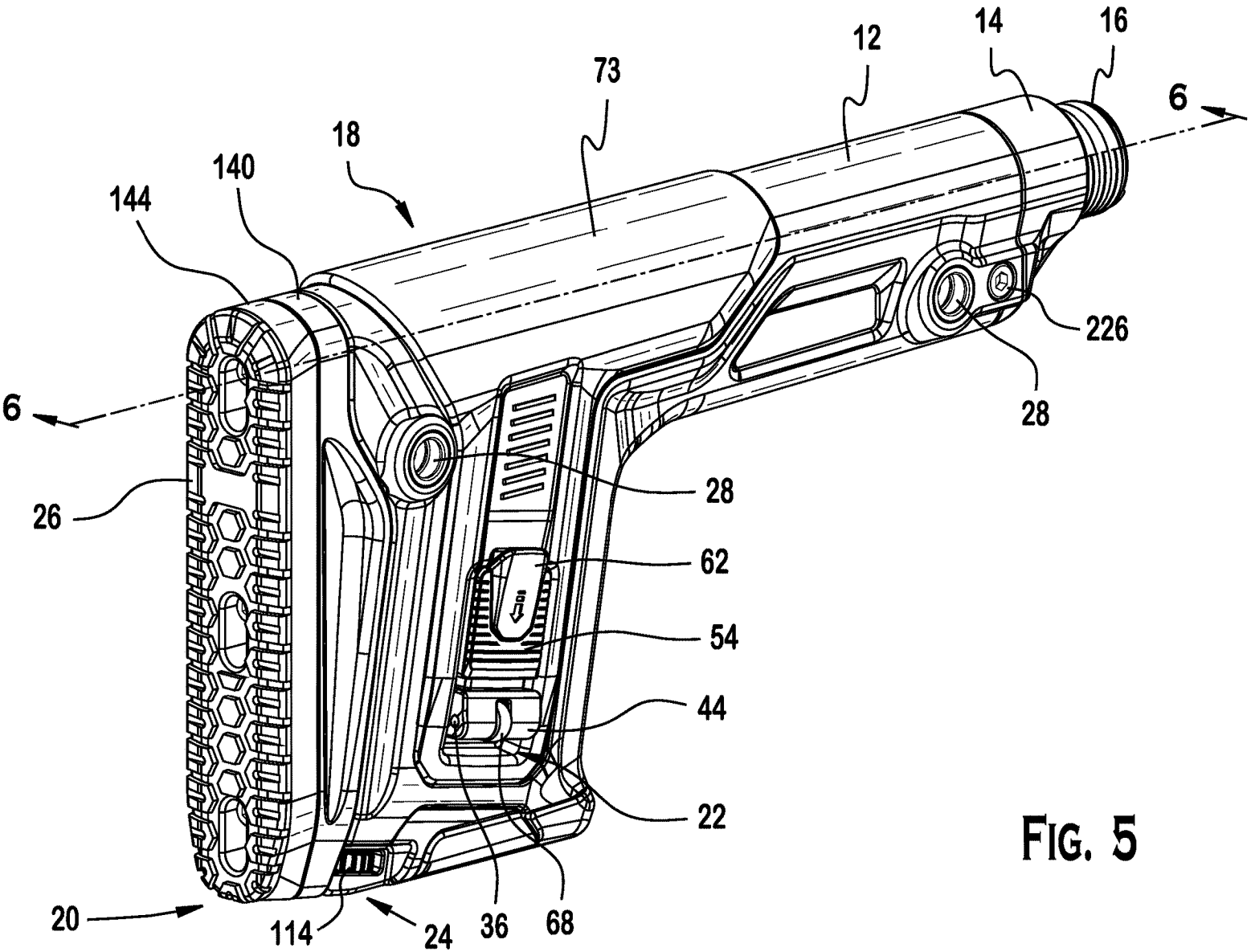
FIG. 5 is perspective view of the stock of FIG. 1 with the butt stock assembly in a collapsed position, the cheek piece in a collapsed position, and the clamp in a secured configuration.
Figure 7:
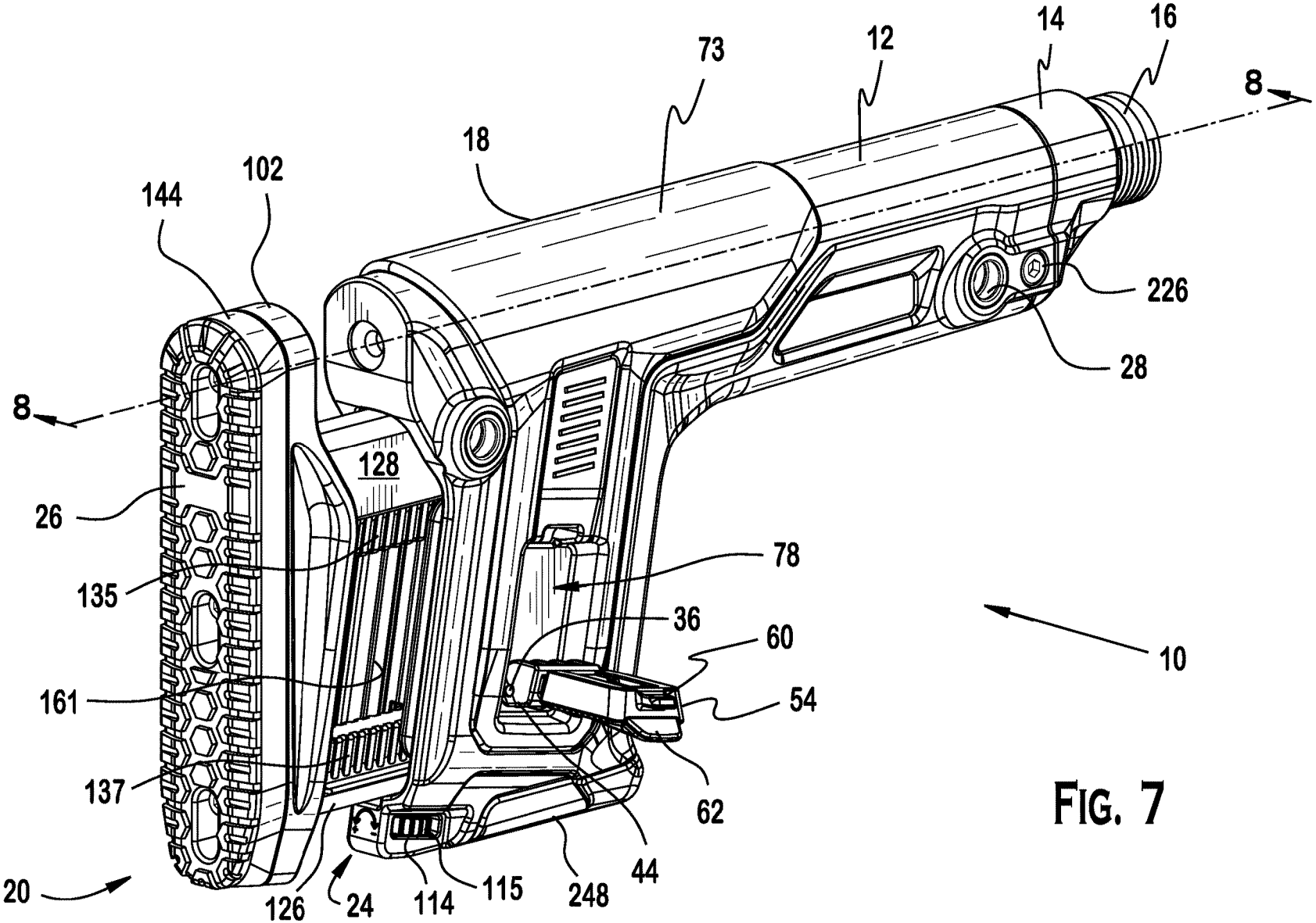
FIG. 7 is perspective view of the stock of FIG. 1 with the butt stock assembly in a fully extended position, the cheek piece in a collapsed position, and the clamp in a released configuration.
Figure 9:
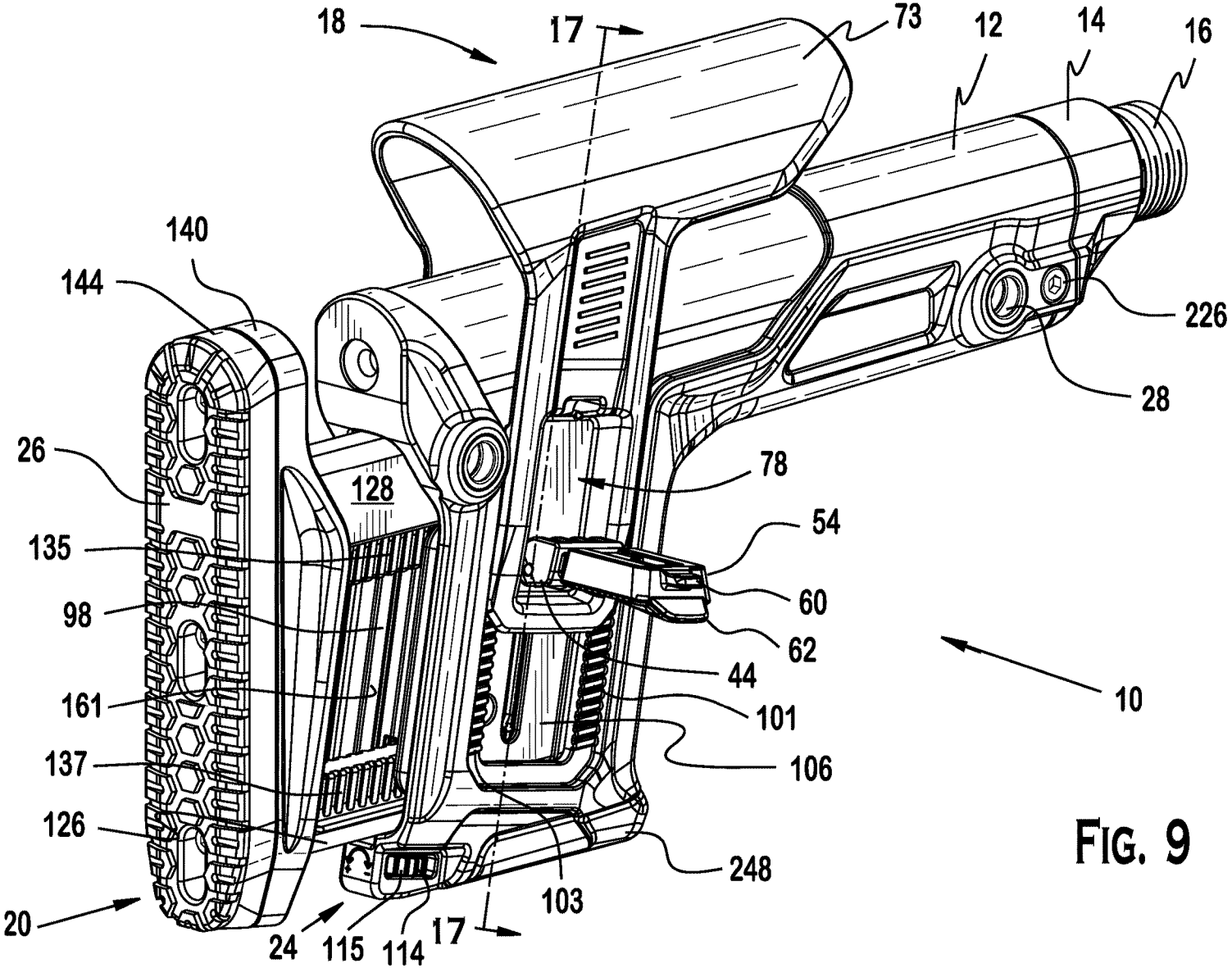
FIG. 9 is perspective view of the stock of FIG. 1 with the butt stock assembly in a fully extended position, the cheek piece in a fully raised position, and the clamp in a released configuration.
Figure 10:
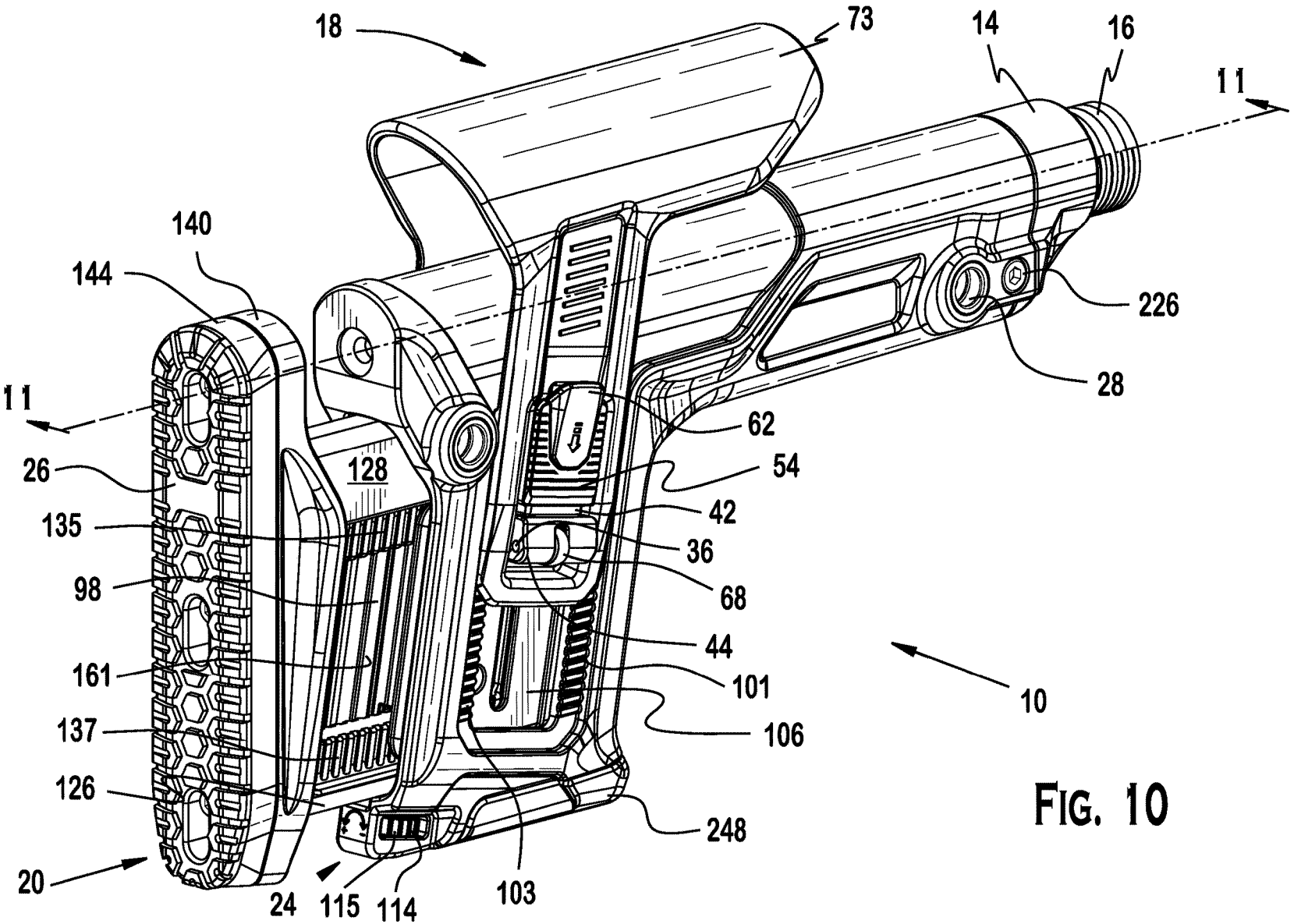
FIG. 10 is perspective view of the stock of FIG. 1 with the butt stock assembly in a fully extended position, the cheek piece in a fully raised position, and the clamp in a secured configuration.
Figure 11:
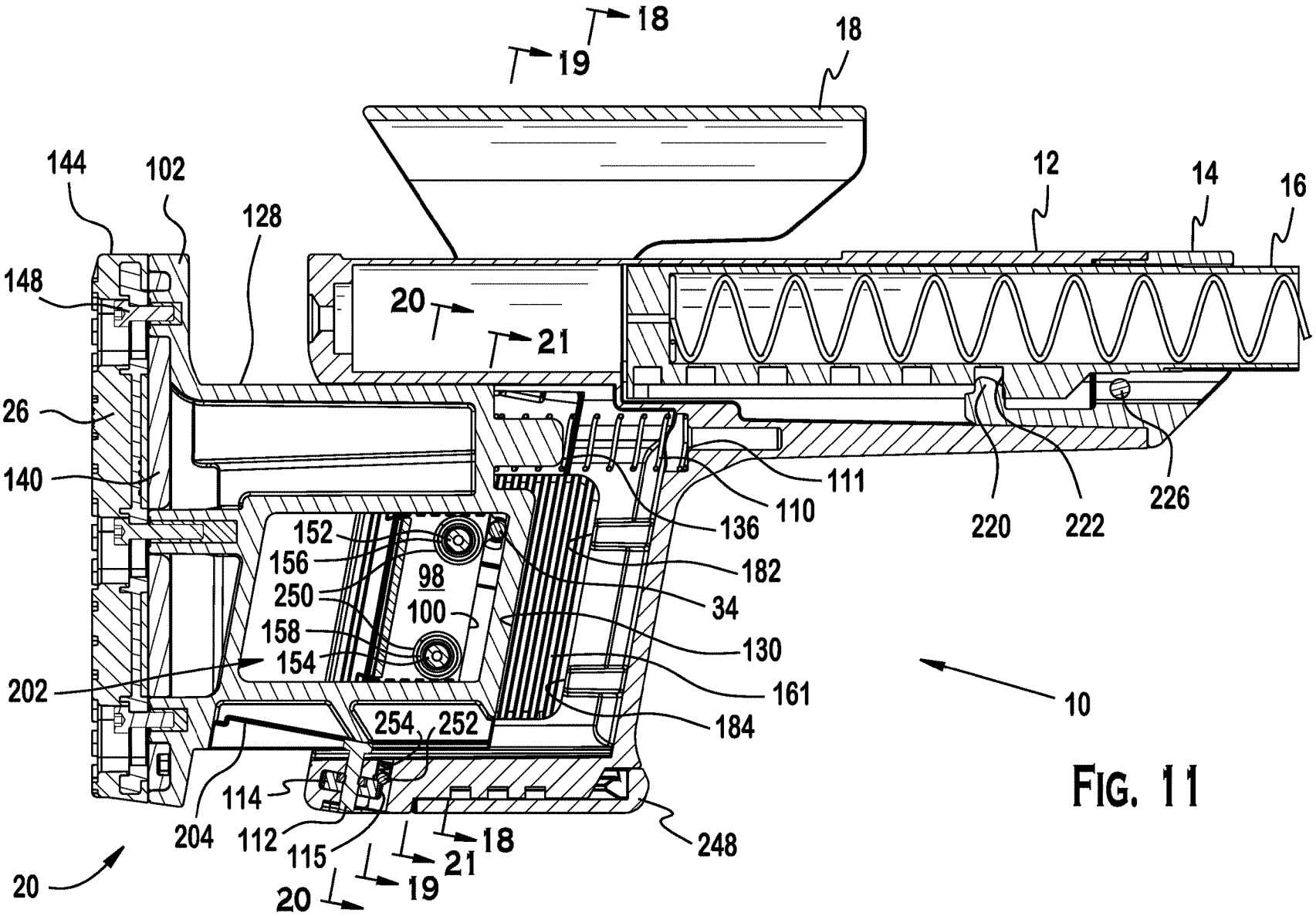
FIG. 11 is cross-sectional view of the stock of FIG. 10 along line 11-11.

Referring to FIG. 7 and FIG. 9, the clamp 30 may be used to position the port side cheek rest riser 76 and the starboard side cheek rest riser 74 with respect to the butt stock body 12. Referring to FIG. 5 and FIG. 10, by contrast, the clamp 30 may be used to secure the position of the cheek piece 18 with respect to the butt stock body 12. Further still, the clamp 30 may be used to secure the port side clamping plate 98 and the starboard side clamping plate 106 with respect to the frame 104, and thus the clamp 30 may be used to selectively position the cheek piece 18, as well as selectively fix the position of the cheek piece and the butt plate assembly 20.

For example, as shown in FIG. 5 and FIG. 12, the lever arm 42 and latch housing 54 may be folded upward such that the eccentric portion 44 is positioned to shorten the clamp 30 and fix the position of the cheek piece 18 with respect to the butt stock body 12, as well as to secure the port side clamping plate 98 and the starboard side clamping plate 106 with respect to the frame 104. See also, FIG. 6, FIG. 14, FIG. 15 and FIG. 21. Moreover, the lever arm 42 and latch housing 54 may be positioned in the starboard side clamp receptacle 78. See e.g., FIG. 12. Furthermore, the latch 60 may be spring biased into a catch 208 (or slot) in the clamp receptacle. Id. The latch 60 may be uncoupled from the catch 208 by depressing the tab 72 of the latch housing. The lever arm and latch housing may then be rotated away from clamp receptacle. See e.g., FIG. 7. Rotation of the lever arm 42 and latch housing 54 away from the clamp receptacle may lengthen the clamp 30 and unfix (or unlock) the position of the cheek piece 18 with respect to the butt stock body 12, as well as to unfix (or unlock) the port side clamping plate 98 and the starboard side clamping plate 106 with respect to the frame 104. See e.g., FIG. 8, FIG. 16 and FIG. 23. Referring to FIG. 9, FIG. 17, FIG. 22, and FIG. 23 in such an unfixed (or unlocked) configuration, an operator may move the lever arm and latch housing to selectively position the cheek piece. Independently, the operator may allow the compression spring 110 to reposition the butt stock assembly. See e.g., FIG. 7 and FIG. 8. Accordingly, the position of the cheek piece 14 may be adjusted by the non-dominant hand of the operator while the dominant hand of the operator holds the firearm grip and obtains a preferred shooting position. See e.g., FIG. 17. In this regard, the position of the butt stock assembly may be adjusted against the spring force applied by the compression spring 110 by applying counter force(s) to the butt plate with the shoulder connected to the operator's dominant hand. Referring to FIG. 10, FIG. 11, FIG. 18 and FIG. 20 upon completion of such a variable adjustment to the position of the cheek piece 18 and butt stock assembly 20, the operator may then fold the lever arm and latch housing up and into the clamp receptacle to fix or lock the selected position of the cheek piece 18 with respect to the butt stock body 12, as well as to fix (or lock) the port side clamping plate 98 and the starboard side clamping plate 106 with respect to the frame 104, and thus achieve a preferred shooting configuration. See also, FIG. 19 and FIG. 21.

Figure 24:
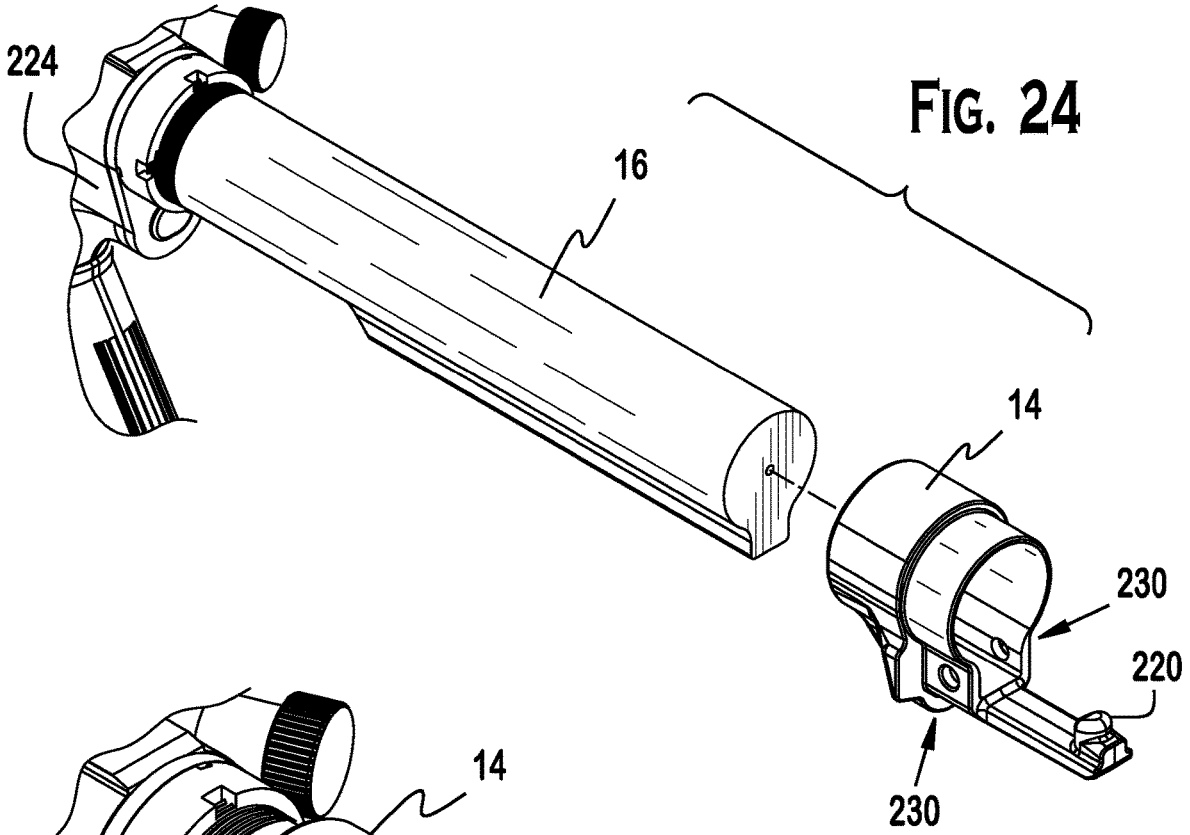
FIG. 24 is partial exploded view of an AR-15 firearm with a buffer tube for a collapsible butt stock and a butt stock adaptor which is configured for use with a receiver extension of a bolt action rifle.
Figure 25:
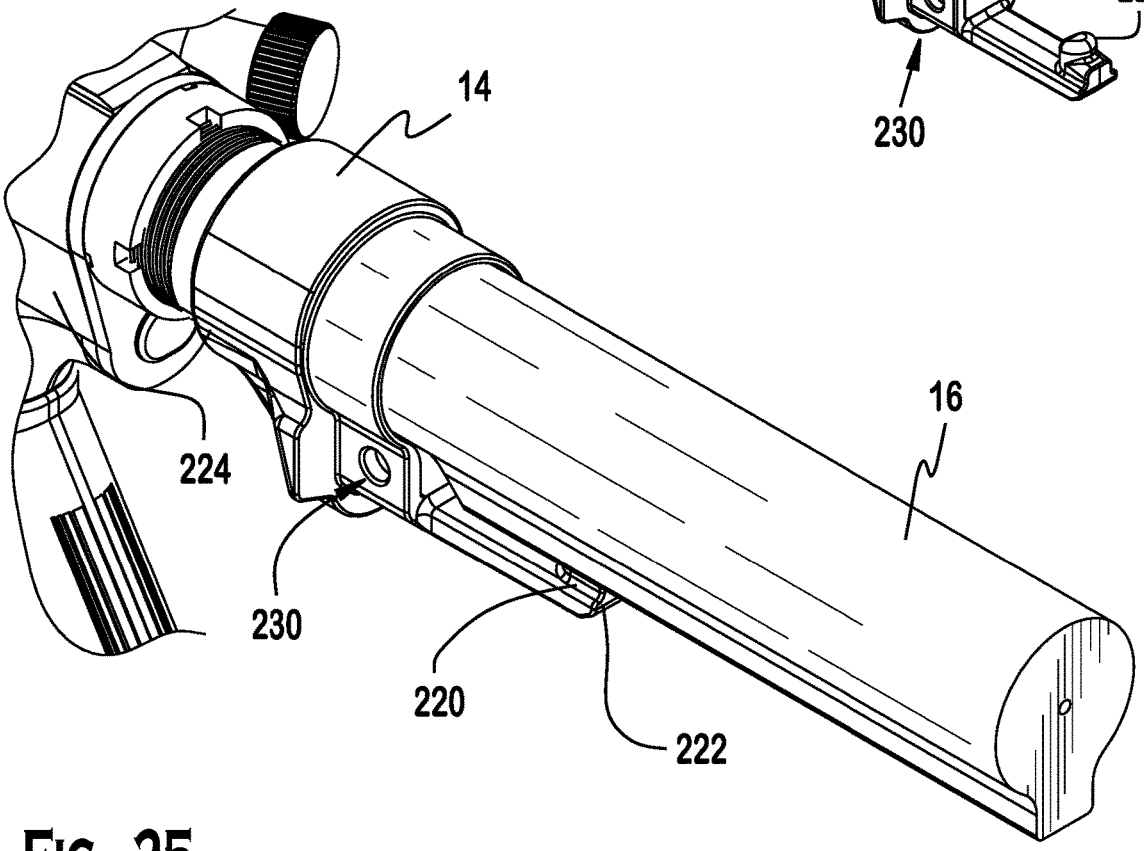
FIG. 25 is partial perspective view of the firearm of FIG. 24 showing the butt stock adaptor fitted to the buffer tube.
Figure 26:
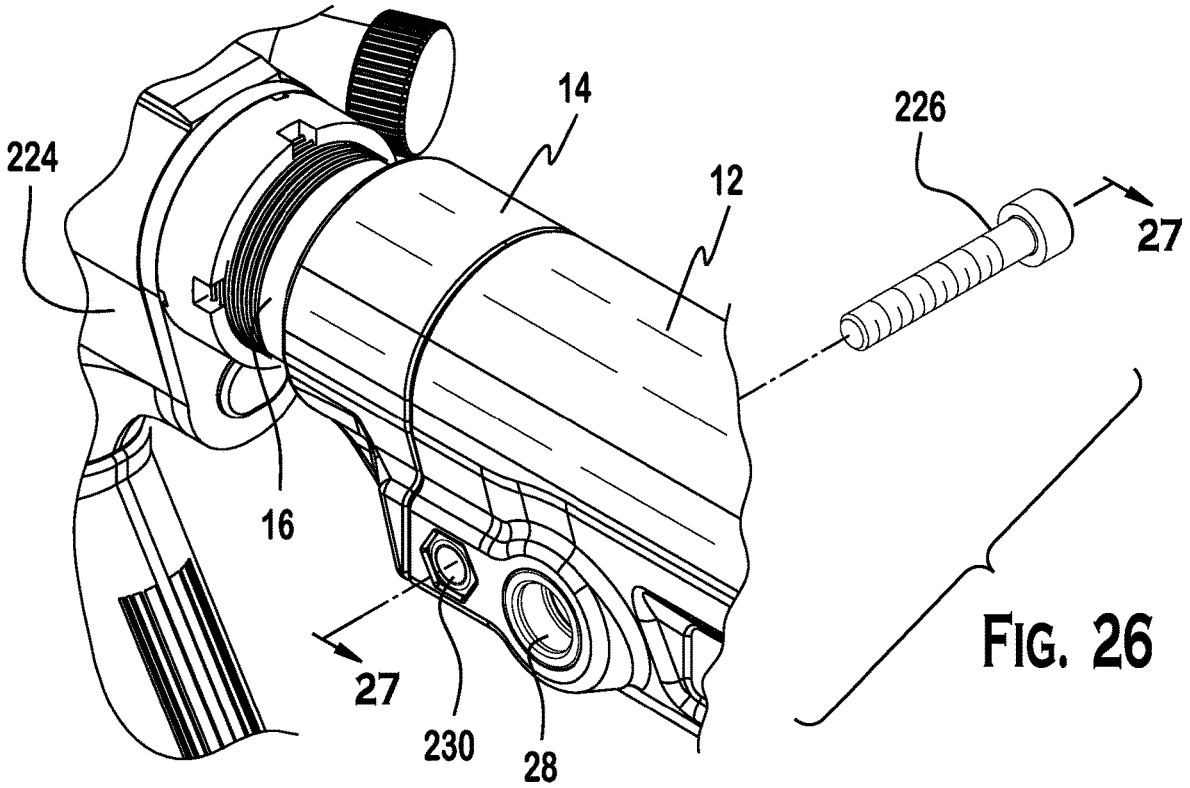
FIG. 26 is partial perspective view of the firearm and butt stock adaptor of FIG. 24 showing the butt stock of FIG. 1 fitted to the butt stock adaptor and the buffer tube.
Figure 27:
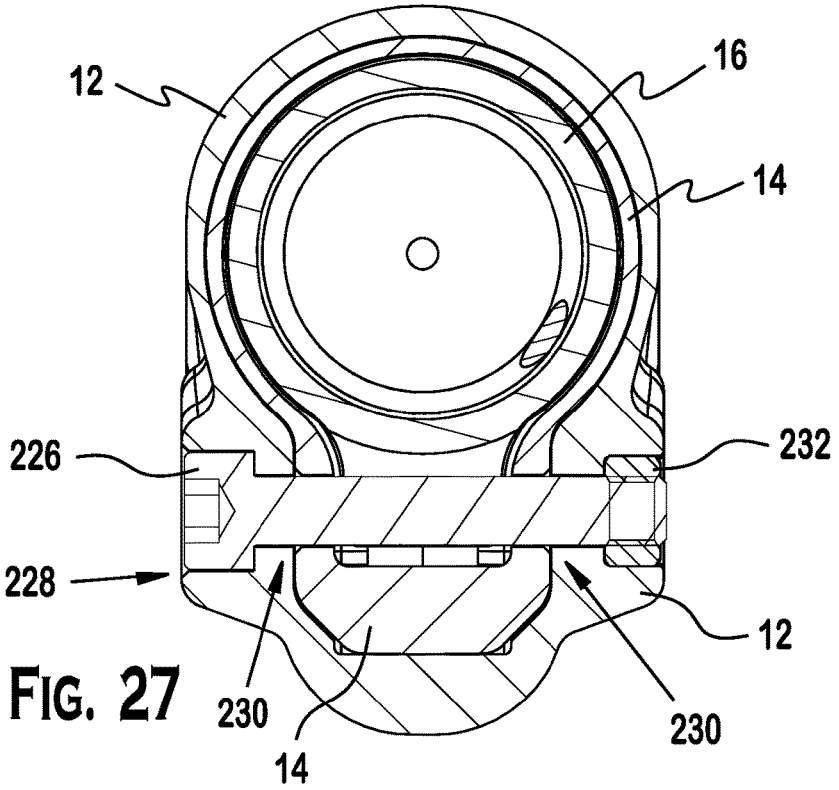
FIG. 27 is cross-sectional view of the fitted butt stock of FIG. 27 along line 27-27.
Figure 28:
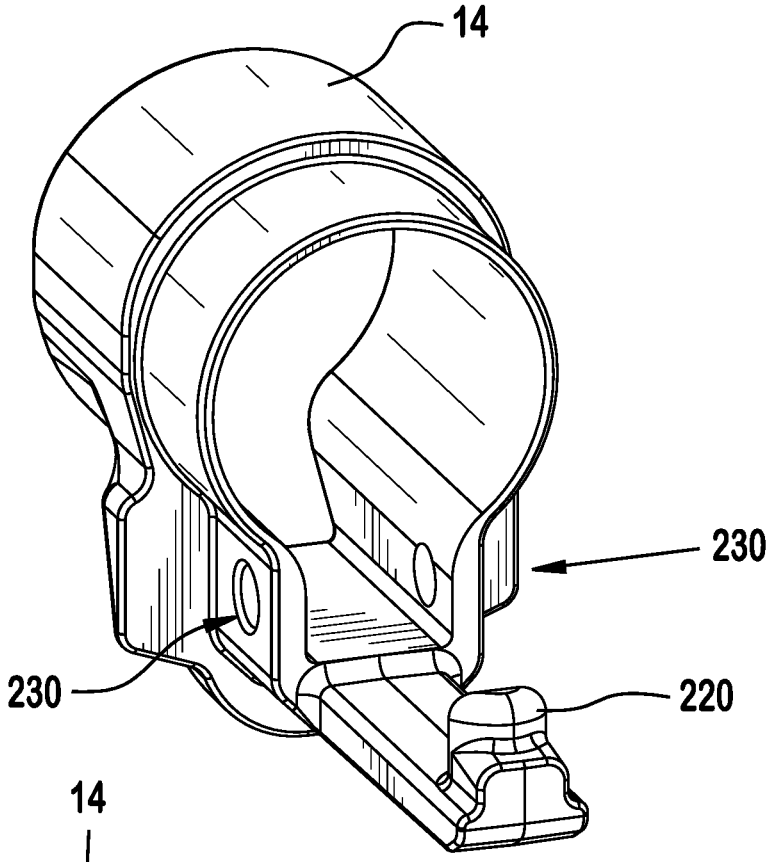
FIG. 28 is a rear, right side, top perspective view of the butt stock adaptor of FIG. 24.
Figure 29:
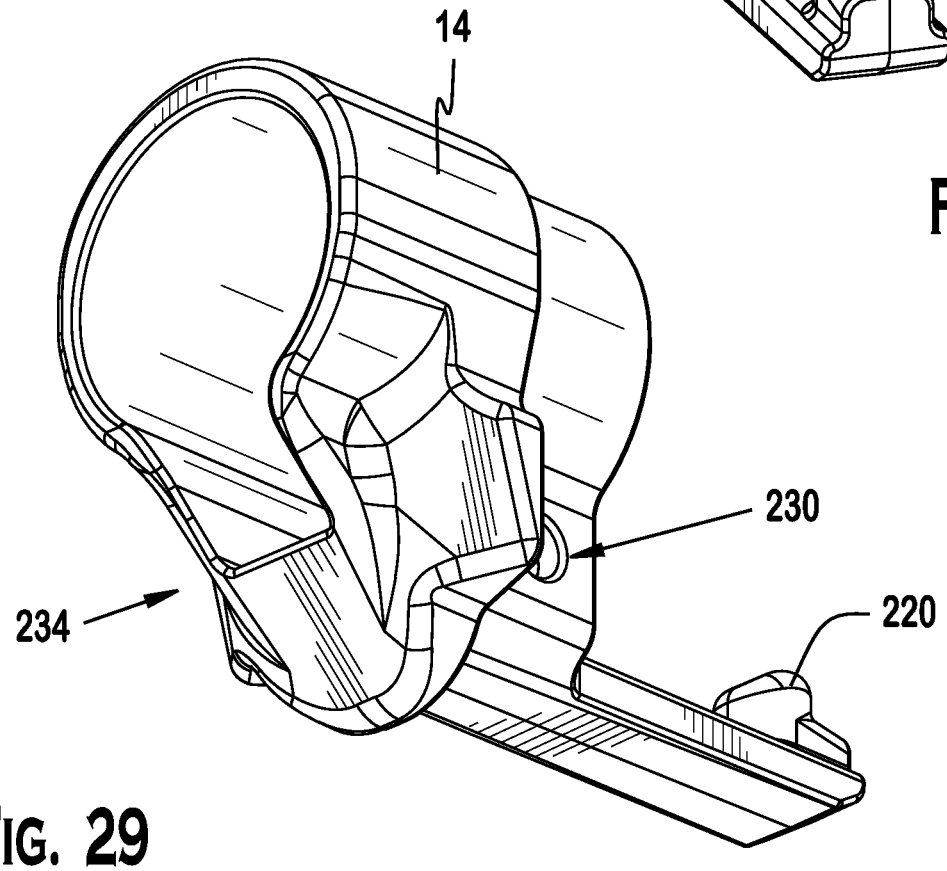
FIG. 29 is a front, right side, bottom perspective view of the butt stock adaptor of FIG. 28.

Referring to FIG. 24 and FIG. 25, an adaptor 14 may be fitted on to a buffer tube 16 (or receiver extension) of a firearm 224. Optionally, a hook 220 on the adaptor may be placed into a stock stop position 222 on the underside of the buffer tube 16 (or receiver extension). As shown in FIG. 26 and FIG. 27, the butt stock body 12 may be fitted over the adaptor 14 and buffer tube (or receiver extension) and secured by a socket head screw 226. The socket head screw 226 may be positioned in a hole 228 near the distal end of the modular stock body 12. Referring to FIG. 27, the socket head screw 226 may pass through a hole 230 in the adaptor 14 and then be received in a captured nut 232 on the opposite side of the modular butt stock body 12. FIG. 28 and FIG. 29 show a first adaptor 14 with a tapered distal end 234 and a proximal hook 220. The first adaptor 14 may be configured and dimensioned for use with a receiver extension of a bolt action rifle. Although the tapered distal end 234 may be configured and dimensioned to provide additional clearance around the grip of a bolt action rifle, the tapered distal end 234 be modified for other firearm types or manufacture.

Figure 30:
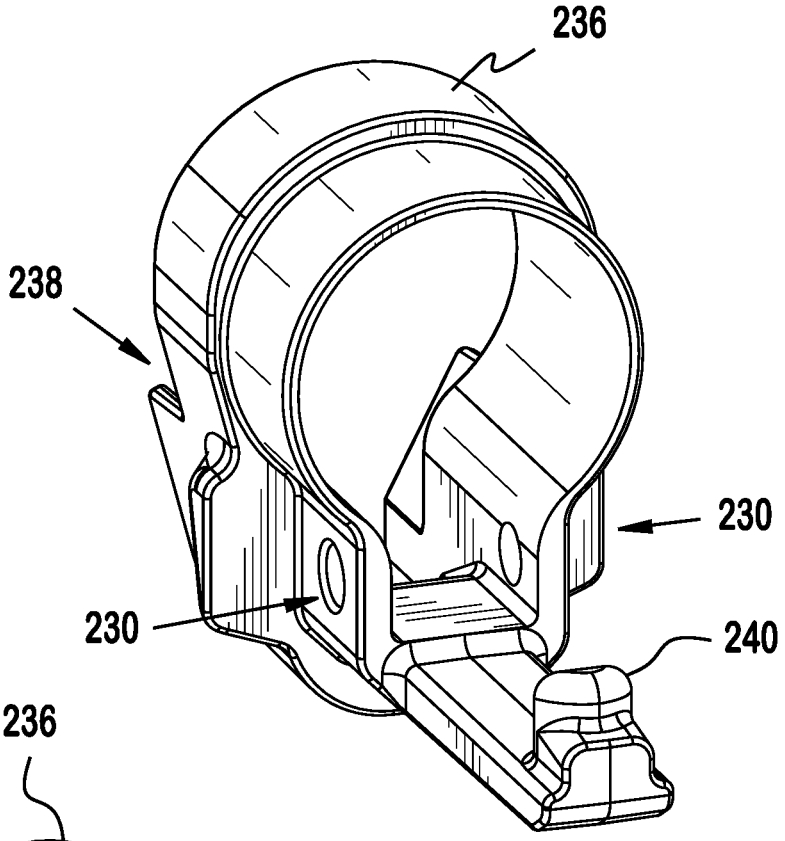
FIG. 30 is a rear, right side, top perspective view of a butt stock adaptor which may be configured and dimensioned for use with a buffer tube (commercial or mil spec) and a collapsible stock for an AR-15 firearm.
Figure 31:
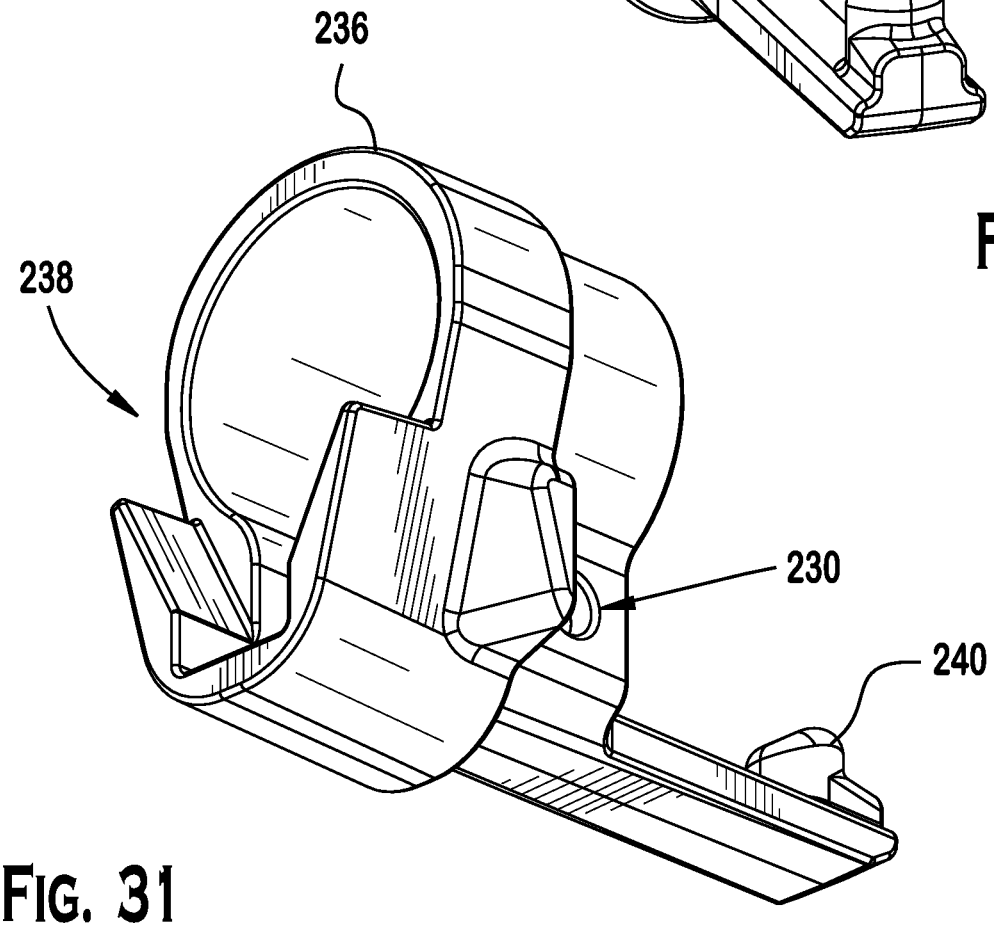
FIG. 31 is a front, right side, bottom perspective view of the butt stock adaptor of FIG. 30.

FIG. 30 and FIG. 31 show a second adaptor 236 with a stepped distal end 238 and a proximal hook 240. The second adaptor 236 may be configured and dimensioned for use with an AR-15 buffer tube (commercial or mil spec) that is designed for use with a collapsible stock.

Figure 32:
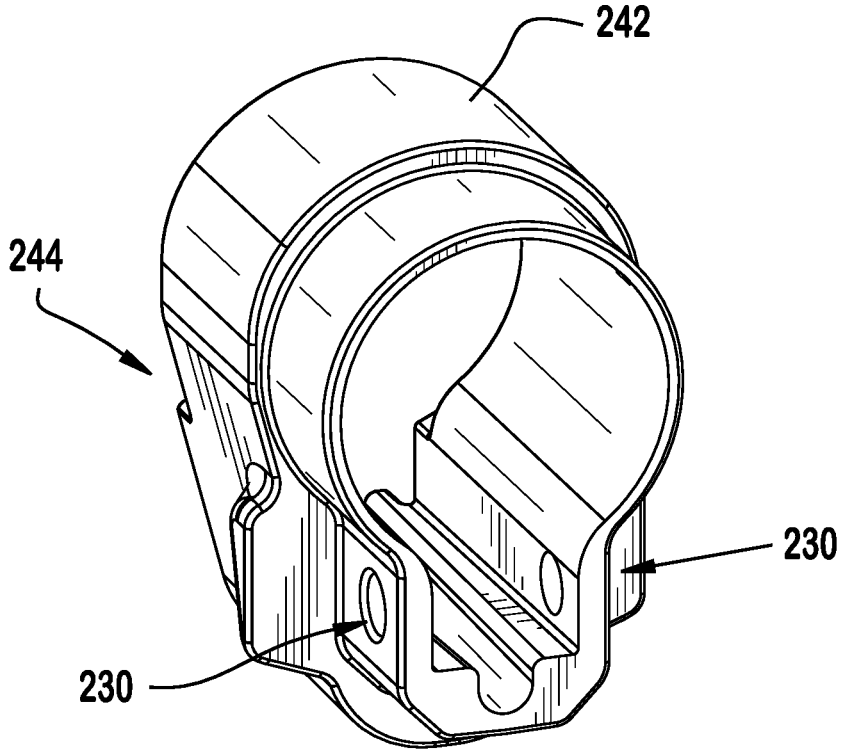
FIG. 32 is a rear, right side, top perspective view of another butt stock adaptor which is configured and dimensioned for use with a rifle length buffer tube (e.g., A2 buttstock receiver extension tube) for use with a fixed stock, including for example an AR-15 A2 or A4 firearm.
Figure 33:
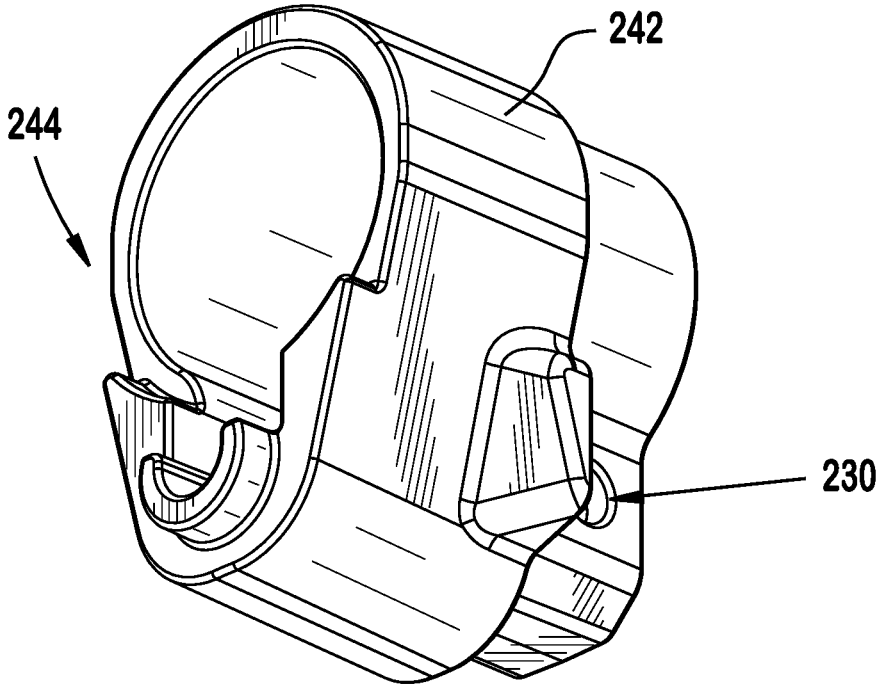
FIG. 33 is a front, right side, bottom perspective view of the butt stock adaptor of FIG. 32.

FIG. 32 and FIG. 33 show a third adaptor 242 with a stepped distal end 244 but without a proximal hook. The third adaptor 242 may be configured and dimensioned for use with a rifle length buffer tube (e.g., A2 standard AR-15 buffer tube) for use with an AR-15 rifle. In use, the third adaptor may be fitted to the distal end of the buffer tube, and the proximal end of the buffer tube may be positioned in the butt stock body until the proximal end abuts the receiver extension tube cavity end wall. A screw further may be advanced through a fastener hole adjacent the butt plate 102 and into the buffer tube to secure the buffer tube body in the cavity. Additionally, a socket head screw may be advanced through the through holes 230 to secure the adaptor to the buffer tube. In alternate embodiments, the first two adaptors also may be respectively implemented without a proximal hook.

FIG. 34 shows an integrally formed picatinny rail 246 formed on the bottom of the butt stock body 12. A rail cover 248 may be positioned over the picatinny rail 246. FIG. 35 shows a perspective view of the rail cover 248. FIG. 36 shows a cross-sectional view of the rail cover 248 mounted on the picatinny rail 246. The picatinny rail 246 may be used to mount a tactical accessory to the butt stock body. Generally, the butt stock body and other components of the butt stock may be constructed from one or more of the following materials, as appropriate and without limitation, metal, metal alloys, wood, plastic, polymer materials, reinforced polymer materials, thermoplastic materials, and combinations thereof.

In view of the above, an exemplary modular stock 10 and associated exemplary adaptors (14, 236, 242) for use with a specific firearm or receiver extension are disclosed (see e.g. FIG. 1, FIG. 2, FIG. 28, FIG. 30 and FIG. 32). In one embodiment, the stock 10 may include a butt stock body 12. The butt stock body 12 may include a first longitudinal axis. The butt stock body 12 further may include a proximal end 13 and a distal end 15 spaced from the proximal end along the first longitudinal axis. As shown in FIG. 4, the butt stock body 12 further may include a butt plate receptacle 108 situated adjacent to the proximal end 13. Also, the modular stock 10 may include a butt plate assembly 20 positioned in the butt plate receptacle 108. Referring to FIG. 3 and FIG. 4, a cheek piece 18 may be secured to the butt stock body 12 and the butt plate assembly 20. Further, the butt stock body 12 may include a clamp 30. The clamp 30 may include first and second configurations such that in the first configuration (e.g., FIG. 9) the clamp permits independent movement of the butt plate assembly 20 and the cheek piece 18 relative to the butt stock body 12, and such that in the second configuration (e.g., FIG. 10) the clamp fixes movement of the butt plate assembly 20 and the cheek piece relative to the butt stock body. Also, in the second configuration, the cheek piece may be clamped against the butt stock body 12 and the butt plate assembly 20.

Referring to FIG. 4, the butt plate receptacle 108 may be housed in the butt stock body 12. The butt plate receptacle may extend from the proximal end 15 of the butt stock body 12 toward the distal end 13 of the butt stock body 12. The butt plate receptacle 108 may include a port side butt plate receptacle sidewall 178, a starboard side butt plate receptacle sidewall 180, and a lower rail receiving track 120 disposed between the port side butt plate receptacle sidewall 178 and the starboard side butt plate receptacle sidewall 180. Additionally, the port side butt plate receptacle sidewall 178 may include a port side upper stop 182, a port side lower stop 184, and a port side opening 116. Further, the starboard side butt plate receptacle sidewall 180 includes a starboard side upper stop 122, a starboard side lower stop 124, and a starboard side opening 118. Referring to FIG. 6, FIG. 8, FIG. 14 and FIG. 15, the butt plate receptacle 108 further may include a butt plate travel adjustment mechanism 113. The butt plate travel adjustment mechanism 113 may include a screw 112 and an adjustment knob 114. The adjustment knob 114 may include peripheral recesses that improve the ability of a user to grip and manipulate the adjustment knob. Also, the butt plate adjustment mechanism may include an indexing member 252 which may be biased by a spring 254 against the adjustment knob. Further, the indexing member may be seated against one of the peripheral recesses to secure the relative position of the adjustment knob 114 and screw 112. Preferably, the indexing member may be a ball bearing. Further still, the adjustment knob 114 may be disposed at an acute angle with respect to the lower rail receiving track 120 and connected to the screw by a mating screw thread. For example, the acute angle may range from about 5 degrees to about 60 degrees measured from the horizontal plane upon which the frame 104 translates. More preferably, the acute angle may range from about 8 to about 12. Most preferably, the acute angle may be about 10.5 degrees. Generally, rotation of the adjustment knob in a first direction may advance the screw into the lower rail receiving track 120 to restrict rearward travel of the butt plate assembly 20. By contrast, rotation of the adjustment knob in an opposite direction may withdraw the screw from the lower rail receiving track 120 to increase rearward travel of the butt plate assembly 20. Accordingly, the butt plate travel adjustment mechanism 113 may be used to selectively regulate rearward travel of the butt plate assembly 20.

Referring to FIG. 1 and FIG. 2, the butt stock body 12 may include a quick disconnect mount 28 disposed between the cheek piece 18 and the distal end 13 of the butt stock body. Also, the butt stock body 12 further may include another quick disconnect mount 28 disposed between the cheek piece 18 and the proximal end 15 of the butt stock body. The first quick disconnect mount 28 may include a first circular opening comprising a first center point, and the second quick disconnect mount may include a second circular opening comprising a second center point. The second center point may be spaced from the first center point along a second longitudinal axis, the second longitudinal axis may be parallel to the first longitudinal axis.

Referring to FIG. 4, the butt plate assembly 20 may include a butt plate 102, a butt pad 144, and a cover plate 140 disposed between the butt pad 144 and the butt plate 102. The butt pad 144 further may include a butt plate fastener hole 146. The butt plate fastener hole may possess an elongated shape having a first major axis. The first major axis may be perpendicular to the first longitudinal axis. The butt stock assembly 20 may include a butt plate fastener 148, and the butt plate 102 may include a butt plate fastener attachment site 150. The butt plate fastener attachment site may be configured and dimensioned to connect with the butt plate fastener 148. For example, the butt plate fastener 148 may be a socket head screw, and the butt plate fastener attachment site 150 may be a threaded bore. The butt plate fastener 148 may be positioned in the butt plate fastener hole 146. The butt plate 102 may include a cover plate attachment site 138, the cover plate attachment may be configured and dimensioned to hold the cover plate 140. The cover plate 140 may include a cover plate attachment site receiving hole 142. The cover plate attachment site receiving hole 142 may be configured and dimensioned to receive the cover plate attachment site 138 and block movement of the cover plate 140. In use, the butt stock assembly 20 may include a first operable configuration such that the butt pad 144 is fixed with respect to the butt plate fastener 148 and the butt plate fastener attachment site 150. Also, the butt stock assembly 20 may include a second operable configuration in which the elongated shape of the butt plate fastener hole 146 defines a track for regulating movement of the butt pad 144 with respect to the butt plate fastener 148 in a first direction parallel to the first major axis.

The butt plate 102 further may include a frame 104. The frame may include an upper rail 127 which includes a port side fluted upper rail face 134, a starboard side fluted upper rail face 135, a comb portion 128 positioned between the port side fluted upper rail face 134 and the starboard side fluted upper rail face 135, and a spring guide 136 projecting from the comb portion. The frame may include a lower rail 125. The lower rail may include a port side fluted lower rail face 132, and a starboard side fluted lower rail face 137. The frame further may include a front rail 130 which connects the upper rail 127 and the lower rail 125. Also, the frame 104 may include a passage located between the upper rail 127 and the lower rail 125. The passage may be located between the butt plate 102 and the front rail 130. For example, the passage may have a polygonal shape. In the preferred embodiment, the passage may be rectangular.

Figure 21:
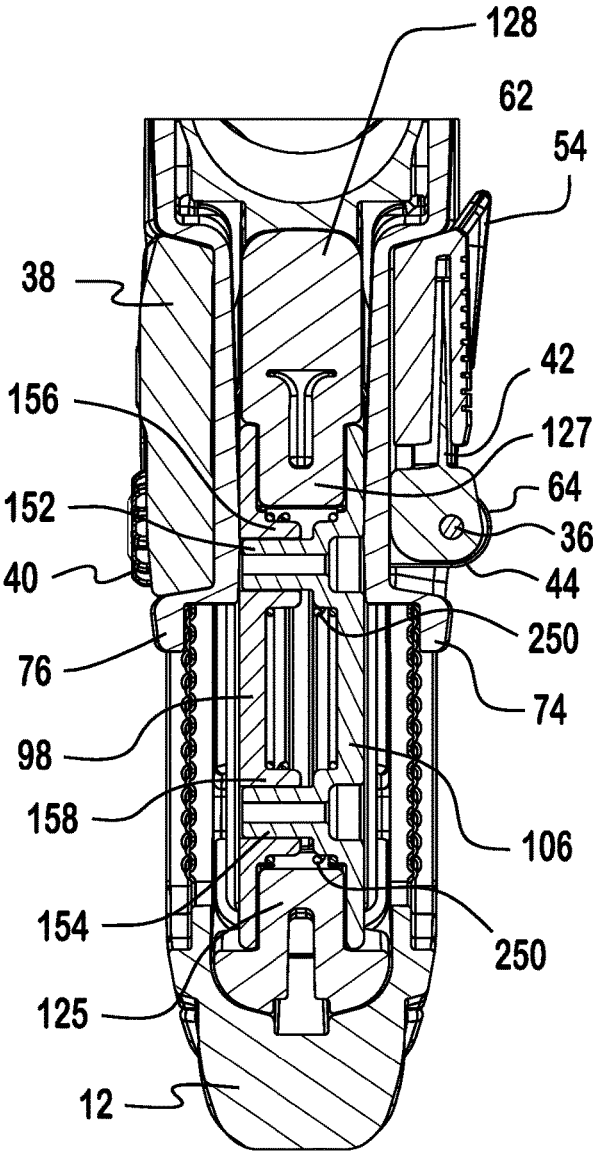
FIG. 21 is cross-sectional view of the stock of FIG. 11 along line 21-21.

The butt stock assembly 20 further may include a port side clamping plate 98. The port side clamping plate may include a first exterior oriented face 99 and a first interior oriented face 101. The butt stock assembly 20 further may include a starboard side clamping plate 106. The starboard side clamping plate may include a second exterior oriented face 166 and a second interior oriented face 168. The port side clamping plate 98 and the starboard side clamping plate 106 may be juxtaposed, and the frame 104 may be positioned between the port side clamping plate 98 and the starboard side clamping plate 106. As shown in FIG. 21, one or more spring 250 may be arranged between the port side clamping plate 98 and the starboard side clamping plate 106.

Figure 19:
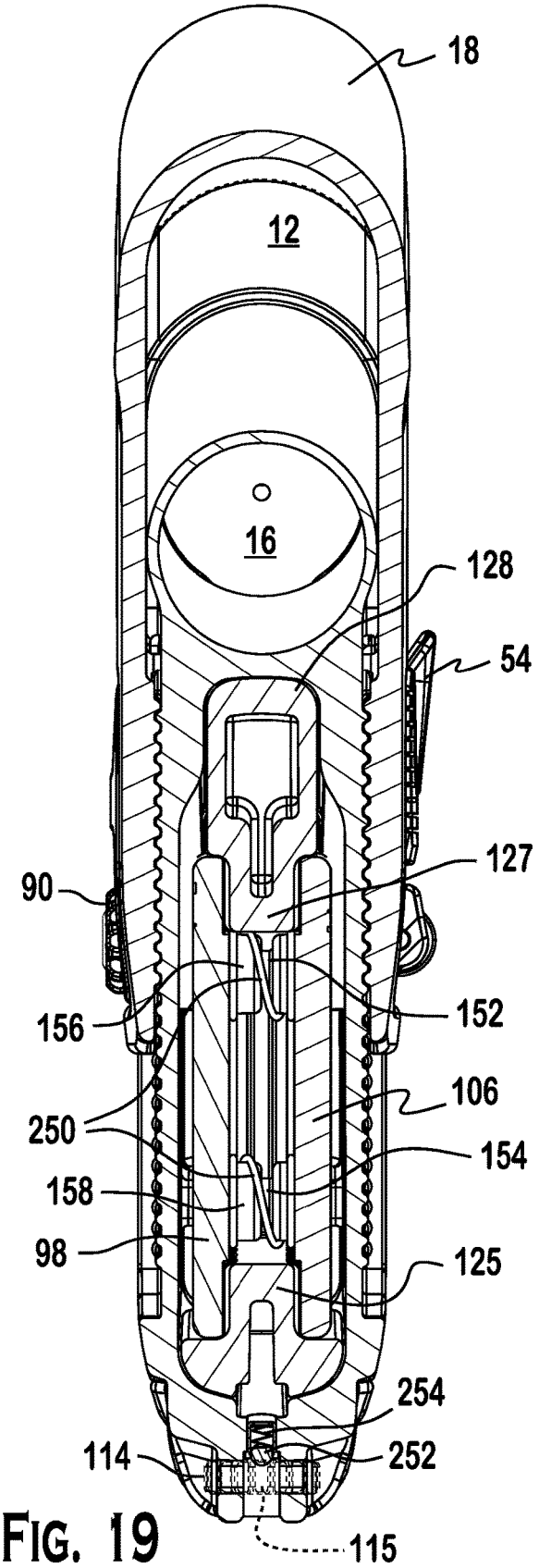
FIG. 19 is cross-sectional view of the stock of FIG. 11 along line 19-19.
Figure 20:
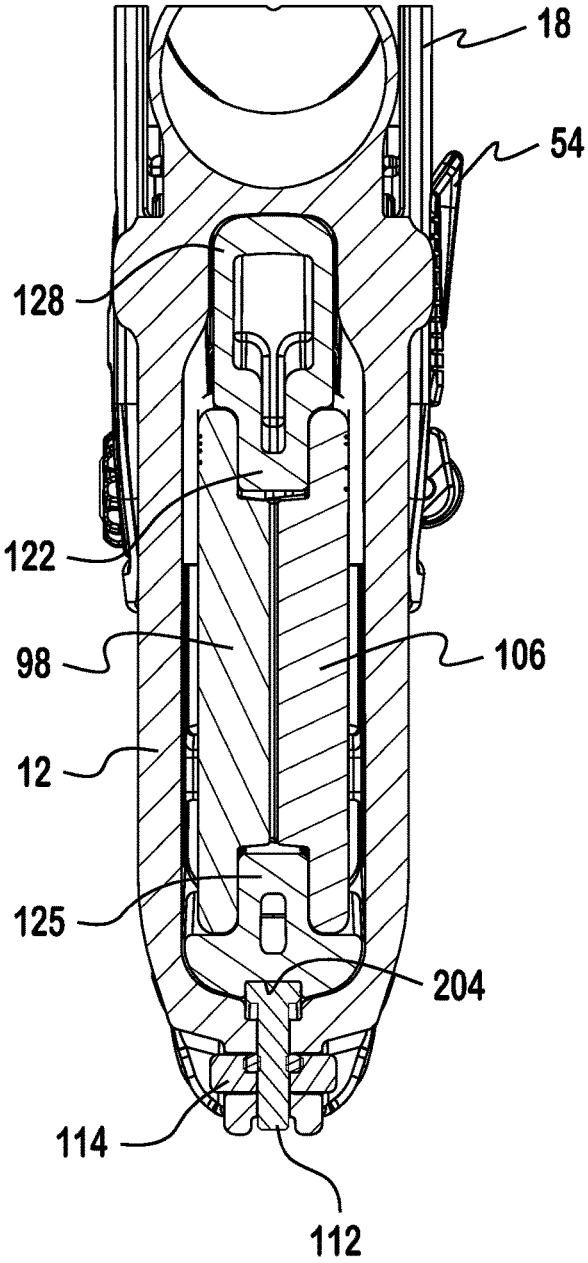
FIG. 20 is cross-sectional view of the stock of FIG. 11 along line 20-20.

The frame 104 may be positioned in the butt plate receptacle 108 such that the lower rail is slidably received in the lower rail receiving track 120. The one or more springs 250 may be a compression spring. As shown in FIG. 19, the one or more springs 250 may be positioned around a port side clamping plate spring guide 152, 154 and a starboard side clamping plate spring guide 156, 158. Referring to FIG. 16, the butt stock assembly 20 may include a drive spring 110 arranged around the spring guide 136.

The port side clamping plate 98 may include a first elongated slot 100. Also, the first interior oriented face 101 may include a first grooved portion 174, the first grooved portion being configured and dimensioned to engage with the port side fluted upper rail face 134. Also, the first grooved portion 174 may be configured and dimensioned to engage with the port side lower upper rail face 132. The first exterior oriented face 101 further may include a first recess 170 extending from the first exterior oriented face 101 toward the first interior oriented face 99. For example, the first recess 170 may possess rectangular shape. The port side clamping plate 98 further comprises a first transverse member 156 receiving hole and a second transverse member 154 receiving hole.

The starboard side clamping plate 106 may include a second elongated slot 164. The second elongated slot may be arranged opposite to the first elongated slot. Also, the starboard side clamping plate 106 may include a second exterior oriented face 166 and a second interior oriented face 168. The second exterior oriented face may include a second recess 172. The second recess may extend from the second exterior oriented face 166 toward the second interior oriented face 168. For example, the second recess 172 may be rectangular in shape. Moreover, the second interior oriented face 168 may include a second grooved portion 176, the second grooved portion 168 may be configured and dimensioned to engage with the starboard side fluted upper rail face 134. Also, the second grooved portion 176 may be configured and dimensioned to engage with the starboard side lower upper rail face 137. The starboard side clamping plate 106 further may include an upper transverse member 152, a lower transverse member 154, and a proximal transverse member 155. The upper transverse member 152 may include a seat for a compression spring. The lower transverse member 152 may include another seat for another compression spring.

The cheek piece 18 may include a cheek rest 73, a port side cheek rest riser 76 connected to the cheek rest, and a starboard side cheek rest riser 74 connected to the cheek rest. The port side cheek rest riser may include a first inner surface 186 facing the starboard side cheek rest riser 74, a first outer surface 188 facing away from the starboard side cheek rest riser 74, and a port side clamp receptacle 80 extending from the first outer surface 188 to a first end wall 194 located between the first inner surface 186 and the first outer surface 188. The first end wall 194 may include a first aperture 84 which extends from the first end wall 194 to the first inner surface 186. Also, the starboard side cheek rest riser may include a second inner surface 190 facing the starboard side cheek rest riser 74, a second outer surface 192 facing away from the starboard side cheek rest riser 74, and a port side clamp receptacle 80 extending from the outer surface 192 to a second end wall 196 located between the second inner surface 190 and the second outer surface 192. The second end wall 196 may include a second aperture which extends from the second end wall 196 to second inner surface 190. The first inner surface 186 of the port side cheek rest riser 76 may include a horizontally fluted track 97. Also, the second inner surface 190 of the starboard side cheek rest riser 74 may include a horizontally fluted track 96.

The clamp 30 may include an eccentric lever 32, a locking rod 34, and an anchor 38. The eccentric lever 32 may include an eccentric portion 44. The eccentric portion may possess a third longitudinal axis 46. The eccentric portion may include a bore 48 extending along the third longitudinal axis 46, and a locking rod receptacle 50 which intersects the bore 48. The eccentric lever 32 further may include a lever arm 42 connected to the eccentric portion 44. The lever arm may include a plurality of resilient hooks 52. Additionally, the eccentric lever 32 may include a latch housing 54 disposed over the lever arm 42. The latch housing may include a plurality of rectangular openings which are configured and dimensioned to form a sliding press fit connection with the plurality of resilient hooks. The eccentric lever 32 further may include a latch 60, a tab 62 offset from the latch; and a compression spring positioned between the lever arm and the latch housing. Further, the locking rod may include a proximal end 64 including a head 68. The head may include a through hole 70. Also, the locking rod may include a distal end 66 opposite the proximal end, and a screw thread 72 adjacent the distal end. The anchor 38 may include a nut receiving receptacle 90, a locking rod receiving bore 198, and a flange 94. The clamp further may include a pin 36 and a nut 40, The nut may include a threaded bore 200. The head 68 may be disposed in the locking rod receptacle 50, the pin 36 may be positioned in the bore 48 and the through hole 70. The nut 40 may be positioned in the nut receiving receptacle 90. The screw thread 72 of the locking rod may be mated with the screw thread 200 of the nut 40.

Figure 13:
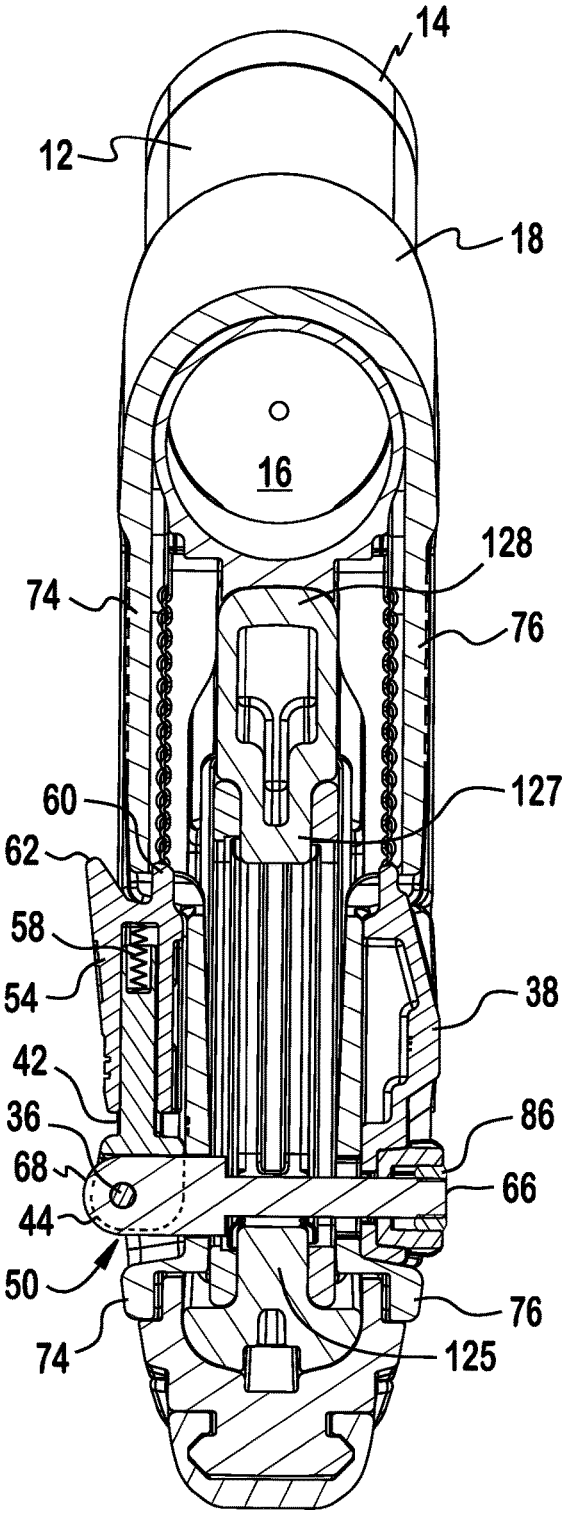
FIG. 13 is a cross-sectional view of the stock of FIG. 12, the clamp being assembled for use by an operator having a left dominant hand.
Figure 14:
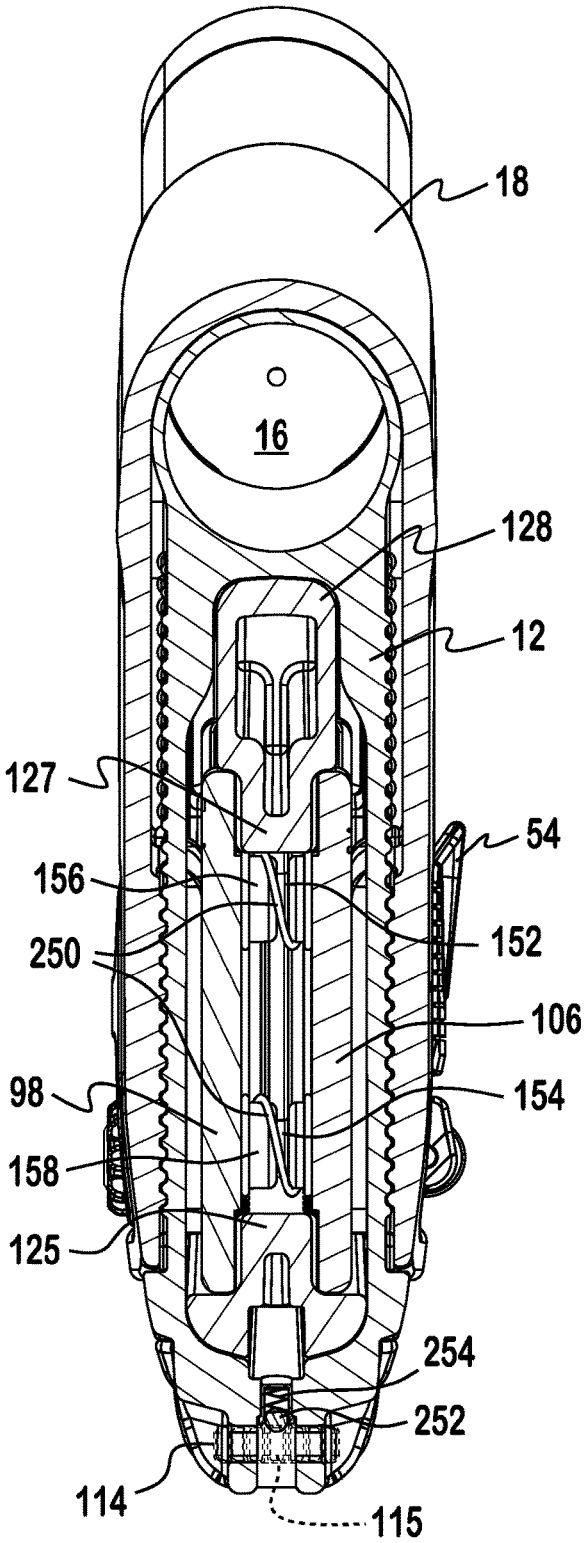
FIG. 14 is cross-sectional view of the stock of FIG. 6 along line 14-14.
Figure 15:
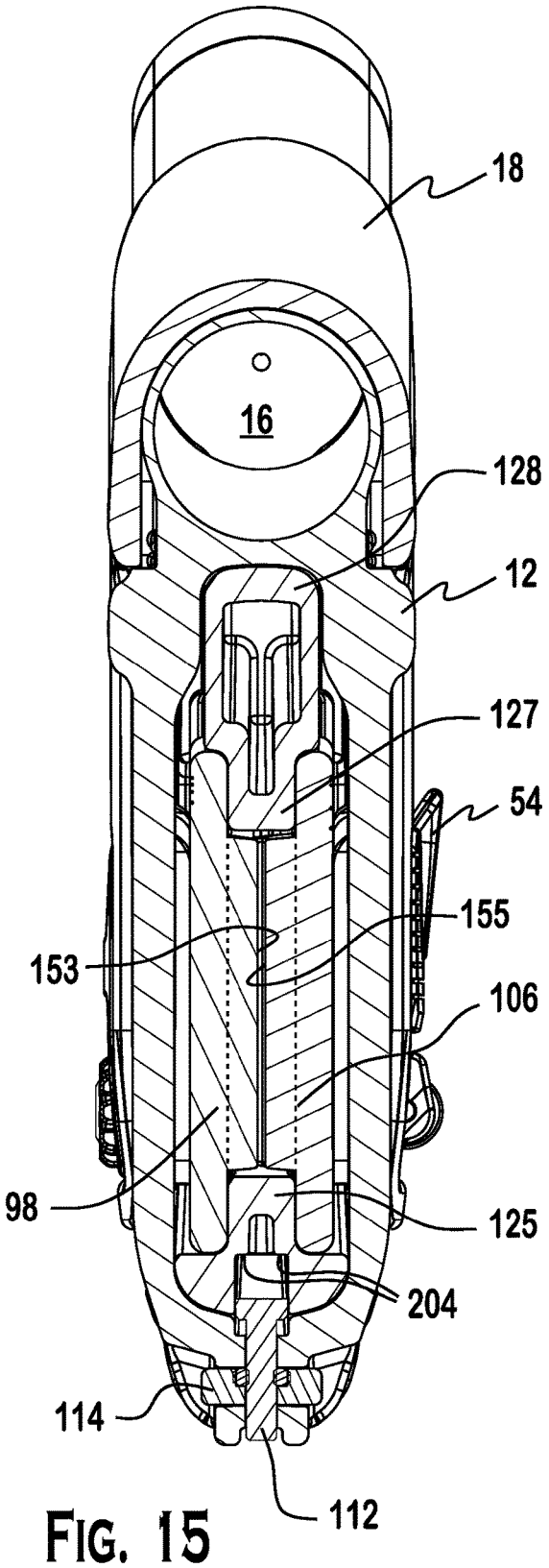
FIG. 15 is cross-sectional view of the stock of FIG. 6 along line 15-15.

Referring to FIG. 12, the clamp 300 may be assembled in a right dominant hand configuration. In the right dominant hand configuration, a user may be able to manipulate the clamp with the user's left hand while maintaining the user's right dominant hand on the pistol grip of the firearm. Referring to FIG. 13, the clamp 300 also may be assembled in a left dominant hand configuration. In the left dominant hand configuration, a user may be able to manipulate the clamp with the user's right hand while maintaining the user's left dominant hand on the pistol grip of the firearm. In this manner, the stock body may provide an ambidextrous set of components that may be selectively assembled in a right dominant hand configuration or a left dominant hand configuration. Thus, the clamp stock may be assembled to provide for precision adjustment of cheek piece elevation and length of trigger pull for a right dominant handed operator or a left dominant handed operator using a single clamp. Thus, an apparatus and method are disclosed in which the clamp stock may be assembled within the stock body 12 to provide for variable adjustment of the butt stock with a dominant hand on the firearm grip, as well as providing for variable adjustment of a butt stock with a nondominant hand. Similarly, a modular stock 10 and one or more adaptors 14, 236, 242 are disclosed which may be packaged as a kit for selectively assembling a left dominant hand configuration of a variably adjustable stock or a right dominant hand configuration of a variably adjustable stock, alone or with one or more adaptors for use with a specific firearm or receiver extension.

While it has been illustrated and described what at present are considered to be preferred embodiments of the invention, it will be understood by those skilled in the art that various changes and modifications may be made, and equivalents may be substituted for elements thereof without departing from the true scope of the invention. For example, the profile of the butt stock body and the components of the first and second variable adjustment regulation assemblies may be adapted for use with a particular geometry, firearm, or tactical requirement. Therefore, it is intended that the invention not be limited to the particular embodiments disclosed herein. Rather, the accompanying claims and their equivalents are intended to cover such forms or modifications as would fall within the scope and spirit of the invention.

What is claimed is:

1. A stock for a gun comprising:

a butt stock body including a first longitudinal axis, the butt stock body comprising a proximal end, a distal end spaced from the proximal end along the first longitudinal axis, and a butt plate receptacle situated adjacent to the proximal end;

a butt plate assembly positioned in the butt plate receptacle;

a cheek piece abutting the butt stock body and the butt plate assembly; and a clamp which comprises first and second configurations such that in the first configuration the clamp permits independent movement of the butt plate assembly and the cheek piece relative to the butt stock body, and such that in the second configuration the clamp fixes movement of the butt plate assembly and the cheek piece relative to the butt stock body, the clamp being coupled to the cheek piece such that translation of the clamp toward the first longitudinal axis selectively positions the cheek piece with respect to the butt stock body, and wherein translation of the clamp is oblique to the first longitudinal axis.

2. The stock of claim 1, wherein in the second configuration the cheek piece is clamped against the butt stock body and the butt plate assembly.

3. The stock of claim 1, wherein the butt plate receptacle is housed in the butt stock body, the butt plate receptacle extending from the proximal end of the butt stock body toward the distal end of the butt stock body.

4. The stock of claim 3, wherein the butt plate receptacle comprises:

a port side butt plate receptacle sidewall, a starboard side butt plate receptacle sidewall, and a track disposed between the port side butt plate receptacle sidewall and the starboard side butt plate receptacle sidewall.

5. The stock of claim 4, wherein the port side butt plate receptacle sidewall comprises:

a port side upper stop for abutting a port side clamping plate, a port side lower stop for abutting the port side clamping plate, and a port side opening.

6. The stock of claim 5, wherein the starboard side butt plate receptacle sidewall comprises:

a starboard side lower stop for abutting a starboard side clamping plate, and a starboard side opening.

7. The stock of claim 4, wherein the butt plate receptacle further comprises a butt plate travel adjustment mechanism.

8. The stock of claim 7, wherein the butt plate travel adjustment mechanism comprises a screw and an adjustment knob.

9. The stock of claim 8, wherein the adjustment knob is disposed at an acute angle with respect to the lower rail receiving track and is connected to the screw by a mating screw thread such that rotation of the adjustment knob in a first direction advances the screw into the track to selectively limit rearward travel of the butt plate assembly.

10. The stock of claim 1, wherein the butt plate assembly comprises a butt plate;

a butt pad, and a cover plate disposed between the butt pad and the butt plate.

11. The stock of claim 10, wherein the butt pad comprises a butt plate fastener hole, the butt plate fastener hole being of an elongated shape having a first major axis, the first major axis being perpendicular to the first longitudinal axis.

12. The stock of claim 10, wherein the butt plate assembly further comprises a frame adjacent to the butt plate, the frame comprising:

an upper rail which comprises a port side fluted upper rail face, a starboard side fluted upper rail face, a comb portion positioned between the port side fluted upper rail face and the starboard side fluted upper rail face, and a spring guide projecting from the comb portion;

a lower rail which comprises a port side fluted lower rail face, and a starboard side fluted lower rail face; and a front rail which connects the upper rail and the lower rail.

13. The stock of claim 12, wherein the frame further comprises a passage located between the upper rail and the lower rail.

14. The stock of claim 12, wherein the butt plate assembly further comprises a port side clamping plate which comprises a first exterior oriented face;

a first interior oriented face which comprises a first grooved portion, the first grooved portion being configured and dimensioned to engage with the port side fluted upper rail face, and a first elongated slot extending from the first exterior oriented face to the first interior oriented face, and a starboard side clamping plate which comprises a second exterior oriented face, a second interior oriented face which comprises a second grooved portion, the second grooved portion being configured and dimensioned to engage with the starboard side fluted upper rail face, and a second elongated slot, the second elongated slot being disposed opposite to the first elongated slot.

15. The stock of claim 14, wherein the port side clamping plate and the starboard side clamping plate are juxtaposed, and the frame is positioned between the port side clamping plate and the starboard side clamping plate.

16. The stock of claim 15, further comprising a first spring situated between the port side clamping plate and the starboard side clamping plate.

17. The stock of claim 16, wherein the frame, the port side clamping plate, and the starboard side clamping plate are positioned in the butt plate receptacle, and the first spring biases the port side clamping plate and the starboard side clamping plate away from the frame.

18. The stock of claim 17, wherein the butt stock assembly further comprises a second spring positioned around the spring guide, and the second spring biases the frame away from the distal end of the butt stock body.

19. The stock of claim 1, wherein the cheek piece comprises:

a cheek rest, a first cheek rest riser connected to the cheek rest, and a second cheek rest riser connected to the cheek rest.

20. The stock of claim 19, wherein the clamp comprises:

an eccentric lever positioned adjacent to the first cheek rest riser, an anchor positioned adjacent to the second cheek rest riser, and a locking rod arranged through the butt plate receptacle and the butt plate assembly, the locking rod being connected to the eccentric lever and the anchor such that in the second configuration the eccentric lever forms a first clamping member and the anchor forms a second clamping member for fixing movement of the butt plate assembly and the cheek piece relative to the butt stock body.

21. A stock for a gun comprising:

a butt stock body including a first longitudinal axis, the butt stock body comprising a proximal end, a distal end spaced from the proximal end along the first longitudinal axis, and a butt plate receptacle situated adjacent to the proximal end, the butt plate receptacle being housed in the butt stock body, the butt plate receptacle extending from the proximal end of the butt stock body toward the distal end of the butt stock body, the butt plate receptacle comprising, a port side butt plate receptacle sidewall, which comprises, a port side upper stop for abutting a port side clamping plate, a port side lower stop for abutting the port side clamping plate, and a port side opening, a starboard side butt plate receptacle sidewall, a track disposed between the port side butt plate receptacle sidewall and the starboard side butt plate receptacle sidewall, and a butt plate travel adjustment mechanism, which comprises a screw, and an adjustment knob disposed at an acute angle with respect to the track and connected to the screw by a mating screw thread such that rotation of the adjustment knob in a first direction advances the screw into the track to selectively limit rearward travel of the butt plate assembly;

a butt plate assembly positioned in the butt plate receptacle;

a cheek piece abutting the butt stock body and the butt plate assembly; and a clamp which comprises first and second configurations such that in the first configuration the clamp permits independent movement of the butt plate assembly and the cheek piece relative to the butt stock body, and such that in the second configuration the clamp fixes movement of the butt plate assembly and the cheek piece relative to the butt stock body, the clamp being coupled to the cheek piece such that translation of the clamp toward the first longitudinal axis selectively positions the cheek piece with respect to the butt stock body.

22. A stock for a gun comprising:

a butt stock body including a first longitudinal axis, the butt stock body comprising a proximal end, a distal end spaced from the proximal end along the first longitudinal axis, and a butt plate receptacle situated adjacent to the proximal end;

a butt plate assembly positioned in the butt plate receptacle, the butt plate assembly comprising a butt plate, a butt pad, a cover plate disposed between the butt pad and the butt plate, and a frame adjacent to the butt plate, the frame comprising an upper rail which comprises a port side fluted upper rail face, a starboard side fluted upper rail face, a comb portion positioned between the port side fluted upper rail face and the starboard side fluted upper rail face, and a spring guide projecting from the comb portion;

a lower rail which comprises a port side fluted lower rail face, and a starboard side fluted lower rail face; and a front rail which connects the upper rail and the lower rail;

a cheek piece abutting the butt stock body and the butt plate assembly; and a clamp which comprises first and second configurations such that in the first configuration the clamp permits independent movement of the butt plate assembly and the cheek piece relative to the butt stock body, and such that in the second configuration the clamp fixes movement of the butt plate assembly and the cheek piece relative to the butt stock body, the clamp being coupled to the cheek piece such that translation of the clamp toward the first longitudinal axis selectively positions the cheek piece with respect to the butt stock body.

* * * * *